US006732656B1

(12) United States Patent
Heyse et al.

(10) Patent No.: US 6,732,656 B1
(45) Date of Patent: May 11, 2004

(54) HIGH VOLTAGE TOLERANT EXPLOSIVE INITIATION

(75) Inventors: Mark W. Heyse, Destin, FL (US); Ronald E. Stearns, Mary Esther, FL (US); Marcus A. Cash, Destin, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 10/244,914

(22) Filed: Sep. 16, 2002

(51) Int. Cl.[7] ..... F42C 15/00

(52) U.S. Cl. ..... 102/202.1; 102/202.2; 102/202.5; 102/202.7; 102/202.8

(58) Field of Search ..... 102/200–215

(56) References Cited

U.S. PATENT DOCUMENTS

| | | | | | |
|---|---|---|---|---|---|
| 2,436,194 | A | * | 2/1948 | Rush | 200/82 B |
| 3,291,937 | A | * | 12/1966 | Carothers | 337/30 |
| 3,618,526 | A | * | 11/1971 | Baker | 102/201 |
| 3,885,501 | A | | 5/1975 | Schneider, Jr. | |
| 4,343,242 | A | * | 8/1982 | Welk | 102/201 |
| 4,359,942 | A | * | 11/1982 | Schmidlin | 102/263 |
| 4,674,047 | A | | 6/1987 | Tyler et al. | |
| 4,700,629 | A | | 10/1987 | Benson et al. | |
| 4,795,113 | A | * | 1/1989 | Minovitch | 244/63 |
| 4,819,560 | A | | 4/1989 | Patz et al. | |
| 4,862,802 | A | * | 9/1989 | Streifer et al. | 102/201 |
| 4,917,014 | A | * | 4/1990 | Loughry et al. | 102/201 |
| 5,101,727 | A | | 4/1992 | Yarrington | |
| 5,148,748 | A | * | 9/1992 | Yarrington | 102/201 |
| 5,173,570 | A | | 12/1992 | Braun | |
| 5,206,455 | A | * | 4/1993 | Williams et al. | 102/201 |
| H1214 | H | * | 8/1993 | Liva et al. | 102/201 |
| 5,245,926 | A | | 9/1993 | Hunter | |
| 5,279,225 | A | * | 1/1994 | Dow et al. | 102/202.2 |
| 5,295,438 | A | | 3/1994 | Hill et al. | |
| 5,404,820 | A | | 4/1995 | Hendrix | |
| 5,413,045 | A | | 5/1995 | Miszewski | |
| 5,488,908 | A | | 2/1996 | Gilpin et al. | |
| 5,520,114 | A | | 5/1996 | Guimard et al. | |
| 5,731,538 | A | | 3/1998 | O'Brien et al. | |
| 5,894,103 | A | | 4/1999 | Shann | |
| 5,929,368 | A | | 7/1999 | Ewick et al. | |
| 5,957,988 | A | | 9/1999 | Osajda et al. | |
| 6,227,114 | B1 | * | 5/2001 | Wu et al. | 102/201 |
| 6,276,276 | B1 | * | 8/2001 | Erickson | 102/201 |
| 6,374,739 | B1 | * | 4/2002 | Smith et al. | 102/221 |
| 6,389,975 | B1 | * | 5/2002 | Haddon et al. | 102/219 |
| 6,439,119 | B1 | * | 8/2002 | Smith et al. | 102/221 |
| 6,460,460 | B1 | * | 10/2002 | Jasper et al. | 102/201 |

* cited by examiner

*Primary Examiner*—Michael J. Carone
*Assistant Examiner*—Troy Chambers
(74) *Attorney, Agent, or Firm*—Gerald B. Hollins; Thomas L. Kundert

(57) ABSTRACT

A fiber-optically-and-pneumatically-controlled firing set for explosive-bridgewire detonators. The firing set consists of a detonation-controlling module and a battery-operated firing module that are interconnected by fiber-optic signal conductors and a pneumatic conduit. The firing set provides high voltage isolation between the control module and the firing module while employing redundant safety features including fail-safe pneumatic crowbar shunting of the firing module output, frequency-selective fiber-optic signal communication, controlled battery life and explosive material detonation enablement and multiple, fail-safe serial switching to control the energy transfer sequence in the firing module. Both high voltage and low potential uses of the invention are included.

20 Claims, 20 Drawing Sheets

Triggering Reliability Verses Battery Voltage

| Source (Batteries) Voltage | Storage Capacitor Voltage | Trigger Capacitor Voltage | Peak Current (Amps) | Time to Peak (uS) | Successful Triggers | Ready Light | Relay Latched | Latched Light | Safe Light Operates |
|---|---|---|---|---|---|---|---|---|---|
| 9.00 | 1970 | 24.4 | 1060 | 0.8 | 1/1 | On | Yes | On | Yes |
| 8.50 | 1860 | 23.0 | 996 | 0.8 | 1/1 | On | Yes | On | Yes |
| 8.00 | 1740 | 21.6 | 948 | 0.8 | 40/40 | On | Yes | On | Yes |
| 7.50 | 1640 | 20.2 | 884 | 0.8 | 110/110 | On | Yes | On | Yes |
| 7.25 | 1570 | 19.7 | 860 | 0.8 | 17/20 | Off | Yes | On | Yes |
| 7.00 | 1528 | 19.2 | 836 | 0.8 | 103/110 | Off | Yes | On | Yes |
| 6.50 | 1415 | 17.9 | | | 22/100 | Off | Yes | On | Yes |
| 6.25 | 1350 | 17.0 | | | | Off | Yes | On | Yes |
| 6.00 | 1300 | 16.5 | | | | Off | Yes | On | Yes |
| 5.75 | 1240 | 15.8 | | | | Off | Yes | On | Yes |
| 5.50 | 1180 | 15.1 | | | | Off | Yes | On | Yes |
| 5.25 | 1130 | 14.4 | | | | Off | Yes | On | Yes |
| 5.00 | 1070 | 13.7 | | | | Off | Yes | On | Yes |
| 4.75 | 1010 | 13.1 | | | | Off | Yes | On | Yes |
| 4.50 | 960 | 12.3 | | | | Off | Yes | Off | No |
| 4.25 | 900 | 11.6 | | | | Off | Yes | Off | No |
| 4.00 | 800 | 10.9 | | | | Off | Yes | Off | No |
| 3.75 | 780 | 10.2 | | | | Off | Yes | Off | No |
| 3.50 | 0 | 0.0 | | | | Off | No | Off | No |

*Table 1*

Fig. 4 and Fig. 5 Schematic Components Identification

| 1 | 2 | 3 |
|---|---|---|
| Legend | Symbol | |
| | | |
| 524 etc | AK1 - AK3 | Air Key, Pneumatic Relay Contacts, (Ak= norm open; $Ak^1$ = norm closed) |
| 554 | $D_1$ ,$D_2$ ,$D_3$ | Zener diodes, IN523 |
| 532 etc | $K_1$ ,$K_2$ ,$K_3$ | Relay TQ2 -5V |
| | $V_1$ ,$V_2$ | Voltage Regulator 5 volts, L 2931 AZ-5 |
| 420 etc | $T_{D1}$,$T_{D2}$ , $T_{D3}$ | Fiber optic signal transducer (transmitter) HPT 2524 |
| 528 etc | $T_{D7}$,$T_{D9}$ , $T_{D11}$ | Fiber optic signal transducer (transmitter) HPT 2524 |
| 431 etc | $T_{D2}$,$T_{D4}$ , $T_{D6}$ | Fiber optic signal transducer (transmitter) HPT 1524 |
| 522 etc | $T_{D8}$,$T_{D10}$ $T_{D12}$ | Fiber optic signal transducer (transmitter) HPT 1524 |
| 580 | EBW | Electric Bridge Wire detonator |
| 570 | $T_1$ | Step-up Pulse transformewr TR 2206 |
| 564 | SCR | Silicon Controlled Rectifier 2N5062 |
| 572 | SG | Spark Gap EG&G GP489 |
| 426 etc | $Q_1$ ,$Q_9$ | NPN transistor 2N2222A |
| 434, 530 | $I_{c1}$ | Tone Decoder ECG 832 |
| 556 | $I_{c2}$ | Quad voltage comparator LM339N |
| 517 | $B_1$ | 9 Volt alkaline battery |
| 540 | $I_1$ | DC to DC Converter GM 12-3KVP |
| 428 | | Manually operated Air Valve |

*Table 2*

HIGH VOLTAGE TOLERANT EXPLOSIVE INITIATION

RIGHTS OF THE GOVERNMENT

The invention described herein may be manufactured and used by or for the Government of the United States for all governmental purposes without the payment of any royalty.

BACKGROUND OF THE INVENTION

In certain specialized situations there is need to employ an explosive charge device in a high voltage electrical environment. More precisely, in some instances it is desirable for an explosive charge device and its detonation/initiating apparatus to remain usable and safe from unintended detonation even though the device is arbitrarily and suddenly elevated in electrical potential from zero or ground potential to a potential of several hundred kilovolts or megavolts. The explosive charge device involved in this environment may be as small and as simple as an explosive bolt of the type often used in rocket and space applications or may be of a larger and more complex nature as needed for explosive disintegration of a larger apparatus or at least its key integration elements. The specialized situations needing this combination of explosive separation or disintegration may exist in certain military weapons environments, particularly in systems employing high-energy and/or high-voltage pulse forming networks or similar apparatus. Needs for this capability may also be found in the electrical utility field where it can be desirable to interrupt the connection between a high voltage source and its load in a simple, rapid, permanent and visible manner. Such disconnection may be appropriate between a transmission line and a transformer primary winding terminal for example.

To date, alternate arrangements having safe detonation/initiation functional capability in the presence of the dual hazards of high explosives and very high voltage are believed not to exist. Although standard explosive fuses, or chemical fuses, may be feasible for normal operation in these environmental conditions, such devices have irresolvable safety problems in an abort-or-misfire situation in, for example, a laboratory test requiring an experimental apparatus to be approached for repair or dismantling.

SUMMARY OF THE INVENTION

The present invention provides a safe and reliable apparatus and method for operating explosive-bridge-wire (EBW) detonators and associated explosive charges that are raised to electrical potentials of hundreds of thousands of volts or megavolts above a surrounding environment. The invention excludes metallic conductors in locations that could disturb electromagnetic fields or short-circuit electrical operating potentials. The invention method and apparatus also meet the safety requirements imposed in connection with explosive materials use in most test and operating environments and enables the safe handling of abort and explosive misfire situations.

It is therefore an object of the present invention to provide an explosive material detonation apparatus and method that are usable in a very high electrical voltage environment.

It is another object of the invention to provide an explosive material detonation arrangement that is also usable in ordinary low voltage or zero voltage environments.

It is another object of the invention to provide an explosive material detonation apparatus that is relatively simple in arrangement and operation.

It is another object of the invention to provide an explosive material detonation apparatus that is manually controlled while having automatic electrical and electronic supervision functions.

It is another object of the invention to provide an explosive material detonation controller allowing safe abortion of an embarked-upon detonation program from plural controller operating states.

It is another object of the invention to provide an explosive material detonation system combining fiber optic and pneumatic communication between two major system components.

It is another object of the invention to provide an explosive material detonation apparatus providing an armed and detonation-enabled period of finite and predictable duration.

It is another object of the invention to provide an explosive material detonation system having large stray electromagnetic signal immunity.

It is another object of the invention to provide an explosive material detonation arrangement that is inclusive of a plurality of safety operating features.

These and other objects of the invention are achieved by instantly segregable elevated electrical potential apparatus comprising the combination of:

an assembly joined together in an electrically insulated, local explosive material-detonation responsive manner;

a source of elevated electrical potential connected between said assembly and a surrounding environment electrical node;

an electrically initiateable charge of explosive material located adjacent portions of said elevated electrical potential assembly;

a quantity-limited depletable source of explosive material-detonation initiating electrical energy located adjacent said charge of explosive material, said quantity-limited source of explosive material-detonation initiating electrical energy being also disposed at said elevated electrical potential with respect to said surrounding environment;

a wired conductor path inclusive of a coded optical energy responsive electrical switching element connecting said quantity-limited source of explosive material-detonation initiating electrical energy with said electrically initiateable charge of explosive material;

said quantity-limited depletable source of explosive material-detonation initiating electrical energy, said wired conductor path, and said coded optical energy responsive electrical switching element comprising an explosive material firing module also disposed at said elevated electrical potential with respect to said surrounding environment;

a detonation controlling module coupled with said firing module by a multiple parallel path fiber optic optical energy signal transmission apparatus;

said multiple parallel path fiber optic optical energy signal transmission apparatus being also electrically non conducting with respect to said elevated electrical potential of said assembly;

said detonation controlling module including electrical circuit means defining a successive sequence plurality of detonation controlling module and firing module operating states including an initial off state, a final state initiating detonating of said electrically initiateable charge of explosive material and a plurality of intermediate operating states;

said detonation controlling module and said firing module including optical signal transmission and reception means for communicating optical signals indicative of existence of selected of said detonation controlling module operating states between said detonation controlling module and said firing module coded optical energy-responsive electrical switching element via said multiple parallel path fiber optic optical energy signal transmission apparatus;

said detonation controlling module and said firing module including optical signal transmission and reception means for communicating optical signals indicative of existence of selected of said firing module operating states between said firing module and said detonation controlling module via said multiple parallel path fiber optic optical energy signal transmission apparatus;

said detonation controlling module also including manually electable operating state termination inputs enabling premature, and non detonating of said explosive material, resetting termination of a selected plurality of said intermediate states in said detonation controlling module and said firing module;

said quantity-limited depletable source of explosive material initiation electrical energy enabling time duration predictions of detonation energy available possible detonating of said explosive material and ensuing commencement of a remainder, insufficient detonation energy available, safe explosive material handling time;

manual operating means for initiating detonation of said explosive material upon transition through a selected plurality of said detonation controlling module and firing module operating states.

BRIEF DESCRIPTION OF THE DRAWINGS

The accompanying drawings incorporated in and forming a part of the specification, illustrate several aspects of the present invention and together with the description serve to explain the principles of the invention. In the drawings.

DETAILED DESCRIPTION OF THE INVENTION

Figure 1:
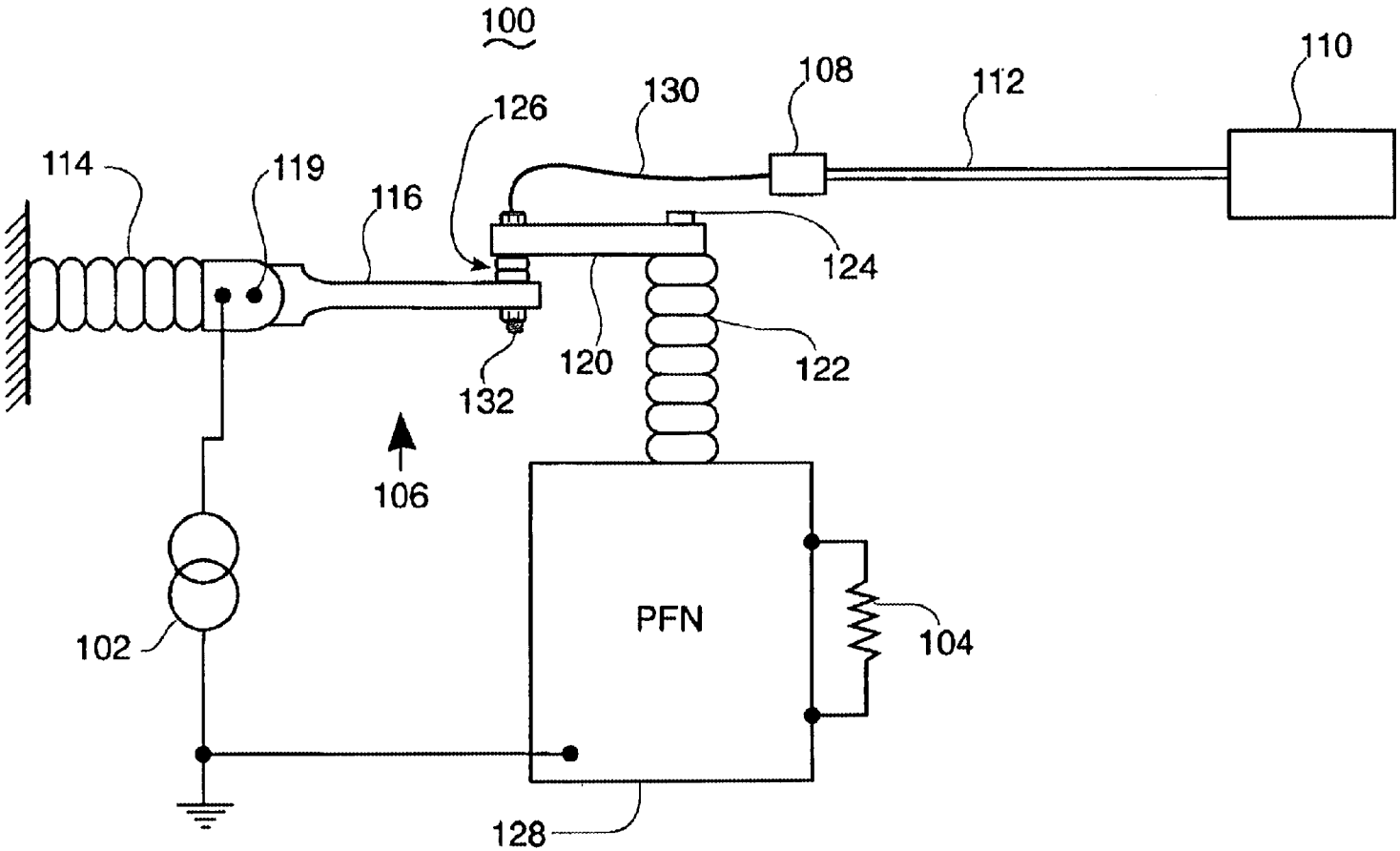
FIG. 1 shows an unusual operating environment in which the present invention may be successfully used.

FIG. 1 in the drawings shows a representative environment in which the present invention may be successfully used. In FIG. 1 a high-voltage electrical apparatus 100 is shown to include a source of high-voltage electrical potential, represented by the source 102, connected by an explosion-responsive connection 106 to a second high-voltage device such as a high energy, high-voltage pulse forming network 128 and then to some electrical load as is represented by the resistance 104. The source of high-voltage electrical potential, represented by the source 102 may be of a direct current, alternating current or pulsating energy nature and can provide potentials in the range of zero volts to hundreds of kilovolts or megavolts for present purposes. For safety and other reason it assumed desirable to include an open and visible disconnection arrangement in the FIG. 1 apparatus.

Such an open and visible disconnection arrangement may be achieved by way of the pair of electrical disconnect switch elements 116 and 120 mounted on the high-voltage-insulators 114 and 122 in the FIG. 1 apparatus. The switch element 116 in the FIG. 1 drawing is pivoted at the point 119 in order to allow a gravity-induced dropping away of this element from the connection with element 120, i.e., the connection represented at 126, during a circuit interruption event. Such drop away interruption of the FIG. 1 high voltage circuit may be accomplished by a disintegration of the explosive bolt member 132 and initiated by apparatus according to the present invention. This present invention apparatus includes the firing module 108, the firing module to explosive material or explosive-bridgewire wired connection at 130 the combination fiber optic and pneumatic communication link 112 and the detonation-controlling module 110. The FIG. 1 apparatus is intended to be only representative of apparatus and situations in which the present invention may be used.

The combination of very high-voltage and explosive materials represented in the FIG. 1 drawing of course suggests the need for careful consideration and abundant safety precaution in arriving at for example the elements 108, 110, 112 and 130 in the present invention. The high-voltage present on the switch elements 116, 119 and 120 in FIG. 1 are readily capable of initiating detonation of the explosive material or an explosive-bridgewire device used in the bolt 132 if such careful consideration and abundant safety precaution are flawed. As appears in certain of the materials following herein the input of a test range safety committee and other safety considerations are important influences over the described embodiment of the present invention.

Figure 2:
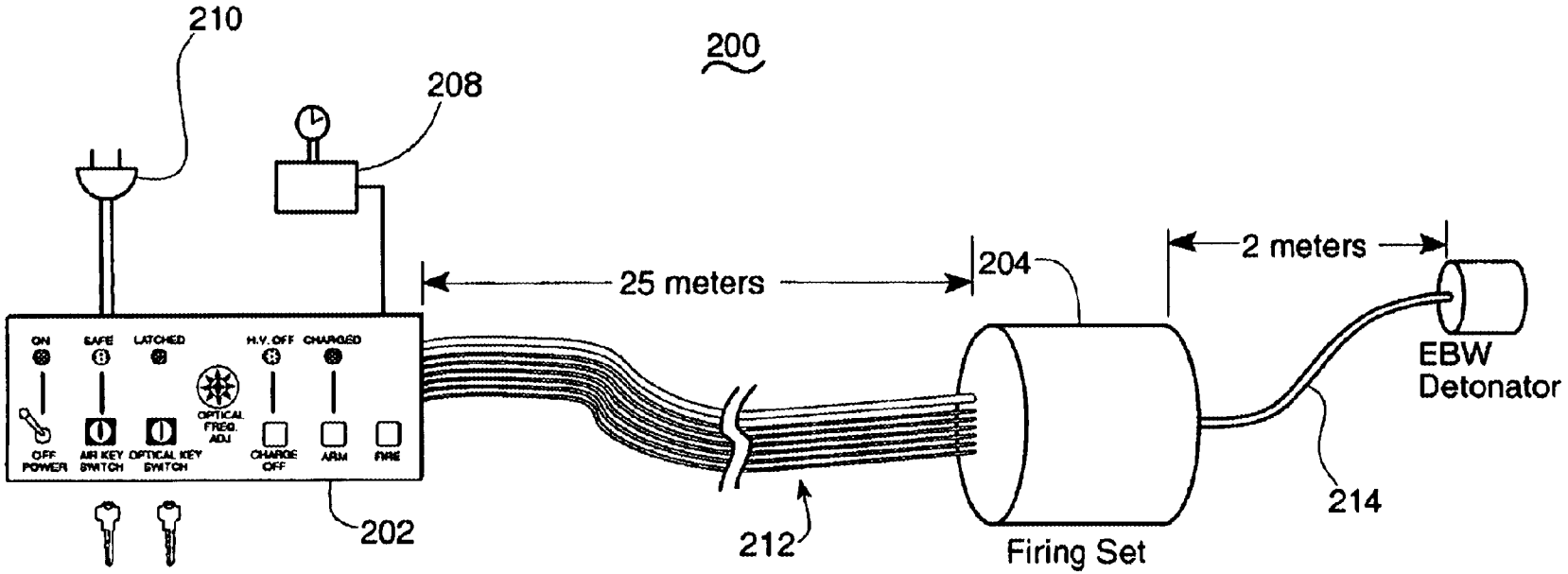
FIG. 2 shows additional overall details of an embodiment of the present invention.

FIG. 2 in the drawings shows the explosive-bridgewire firing apparatus of FIG. 1 in a somewhat more focused, simplified and additional-details representation. The FIG. 2 drawing includes an indication of possible separation distances between portions of the FIG. 1 apparatus and provides general details of the control panel used with the detonation-controlling module of FIG. 1. Also shown in the FIG. 2 drawing is a source of pressurized air 208 such as a small compressor and tank used with the detonation-controlling module to supply the pneumatic tube communication link of the present invention. The power connection for the detonation-controlling module also appears at 210 in FIG. 2.

The fiber optic and pneumatic signal conductors connecting the detonation-controlling module and the firing module of the present invention are represented at 212 in the FIG. 2 drawing. The fiber optic conductors of this group may be made of plastic fiber optic material or alternately, for signal conduction over distances greater than the 25 meters indicated in FIG. 2, may be made of glass fiber optic material including suitable connector members. Additional information regarding the fiber optic signal conductors appears in the Hewlett Packard Company material described elsewhere herein. The coaxial cable 214 of the bridgewire device in FIG. 2 is limited in length by the energy and current rise time requirements of the explosive-bridgewire detonator device used. Manufacturers of these bridgewire detonator devices publish data sheets and application notes useful in relating cable lengths, detonating capacitor size and voltage, coaxial cable size and length and other parameters. In the present instance a type RP-1 explosive-bridgewire device made by Reynolds Industries Systems, Incorporated (RISI) of Northern California (http://risi-usa.com) is found to be suitable. Note also the current magnitude and rise time details disclosed in Table 1 herein relating to the explosive-bridgewire device. Additional details of the detonation-controlling module control panel 202 appear in the FIG. 17 drawing herein.

Figure 3:
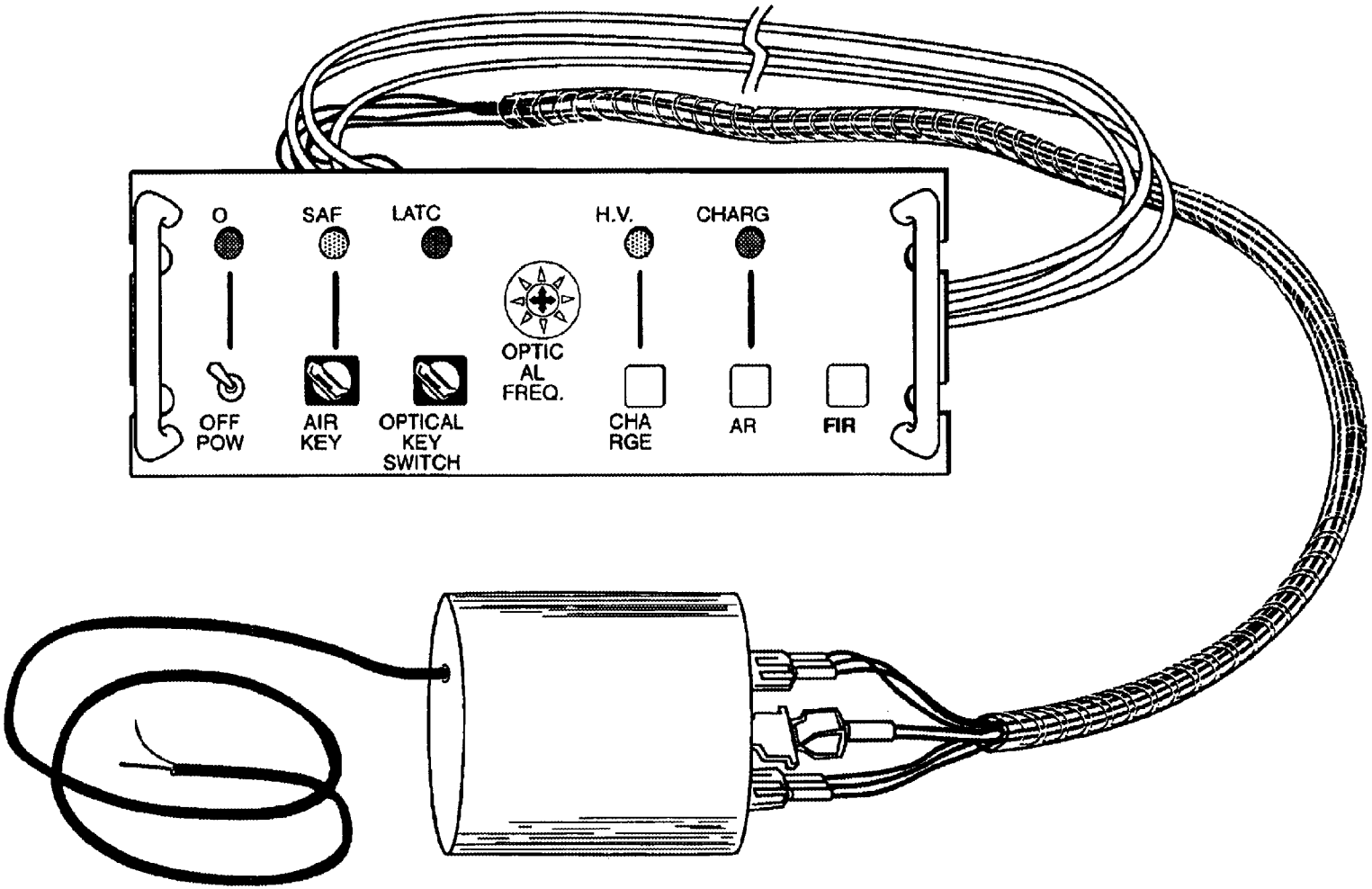
FIG. 3 shows yet additional details of an embodiment of the present invention in closer perspective.

FIG. 3 in the drawings shows yet additional details of the detonation-controlling module 110, 202, and firing module 108, 204 of the present invention in an even closer view. Control panel labels although readable in the FIG. 3 drawing are best observed in the FIG. 17 drawing herein. FIG. 3 also shows the two conductors of the coaxial cable 214, general details of the connector devices used for the fiber optic and pneumatic communication link 112, the coiled sheathing material covering the fiber optic and pneumatic communication link 112 elements, and other details associated with the detonation-controlling module.

Figure 4:
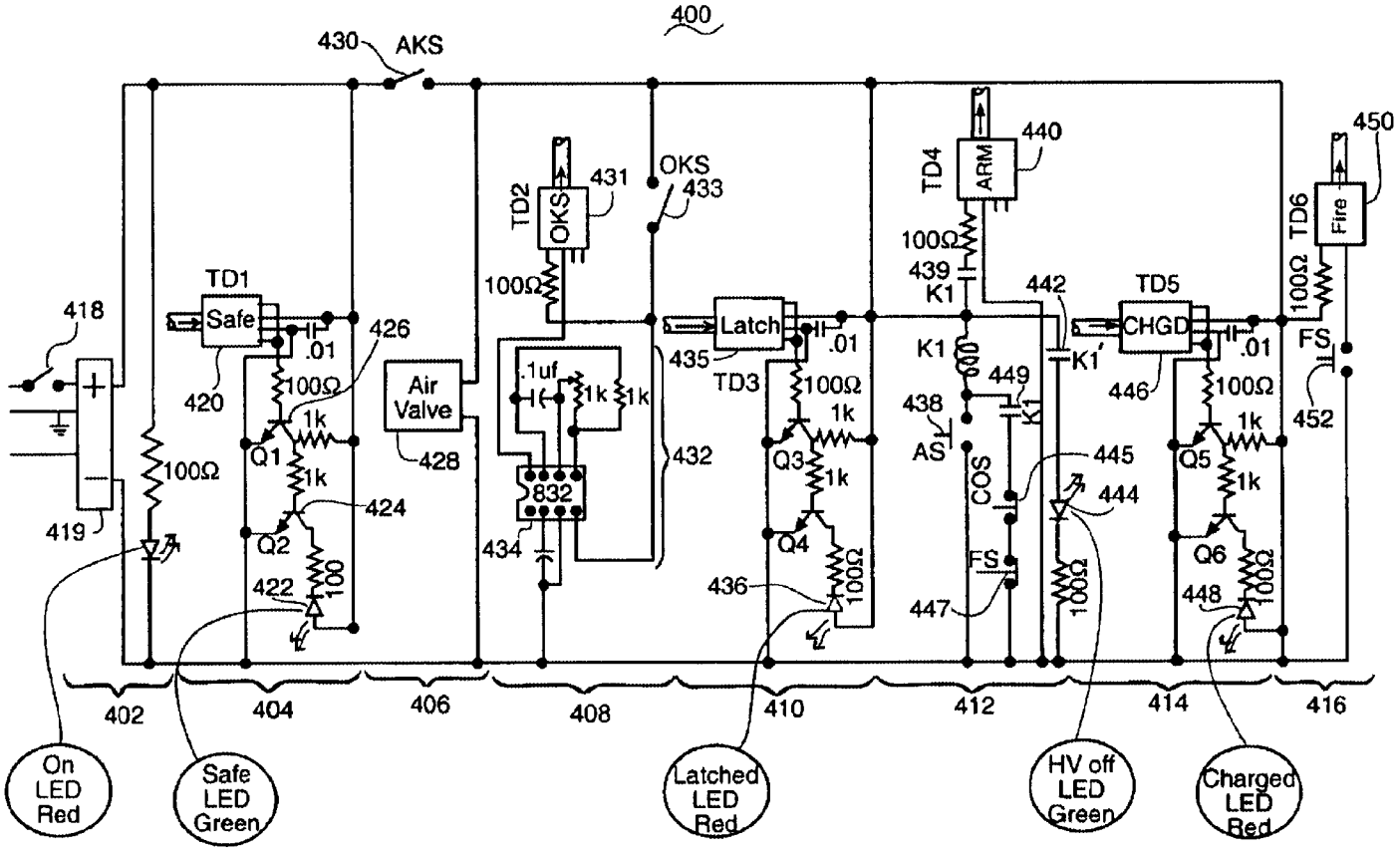
FIG. 4 shows schematic diagram details of a detonation-controlling module according to the present invention.
Figure 5A:
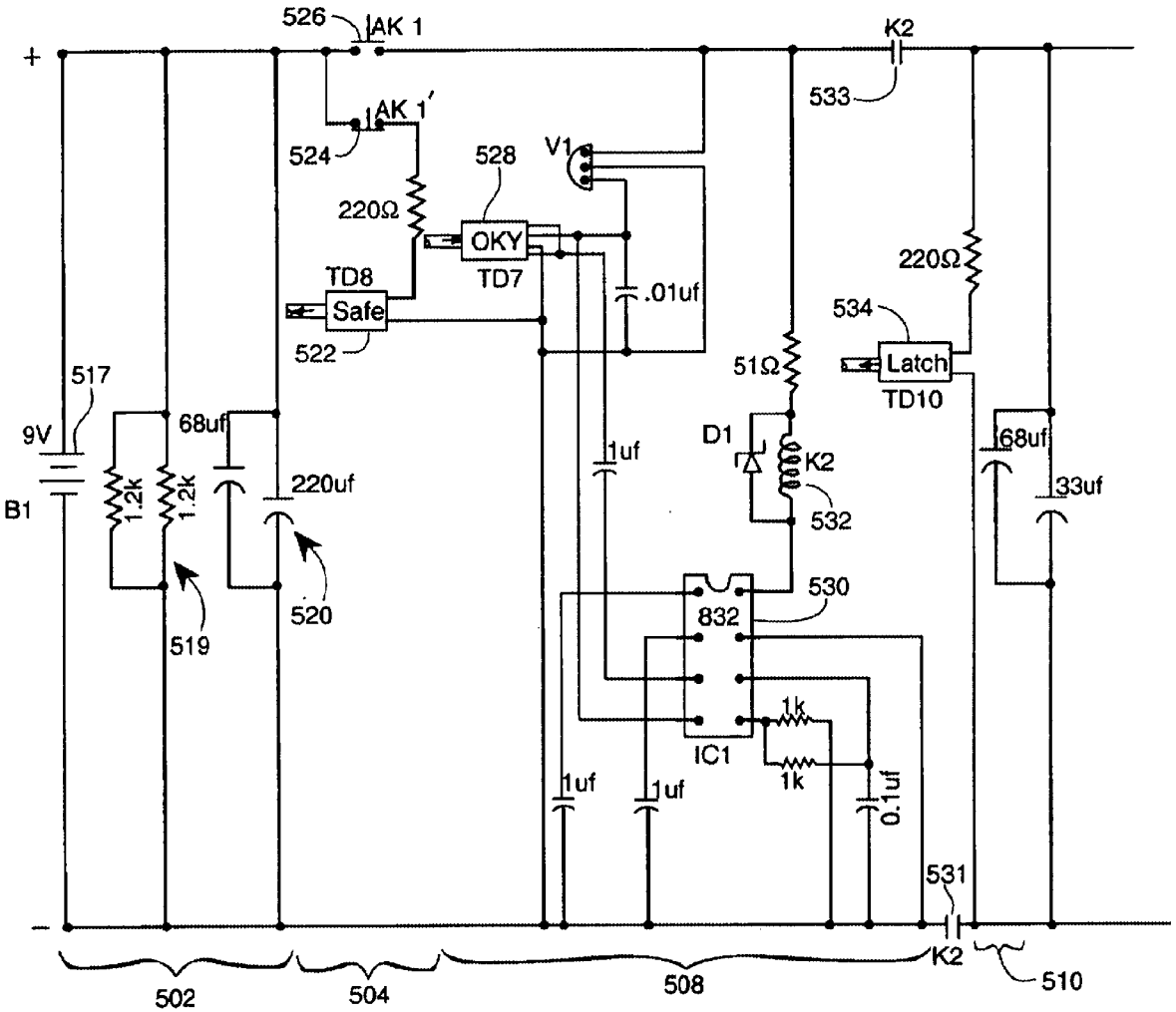
FIG. 5 includes portions FIG. 5*a* and FIG. 5*b* that together show schematic diagram details of an explosive firing module according to the present invention.
Figure 5B:
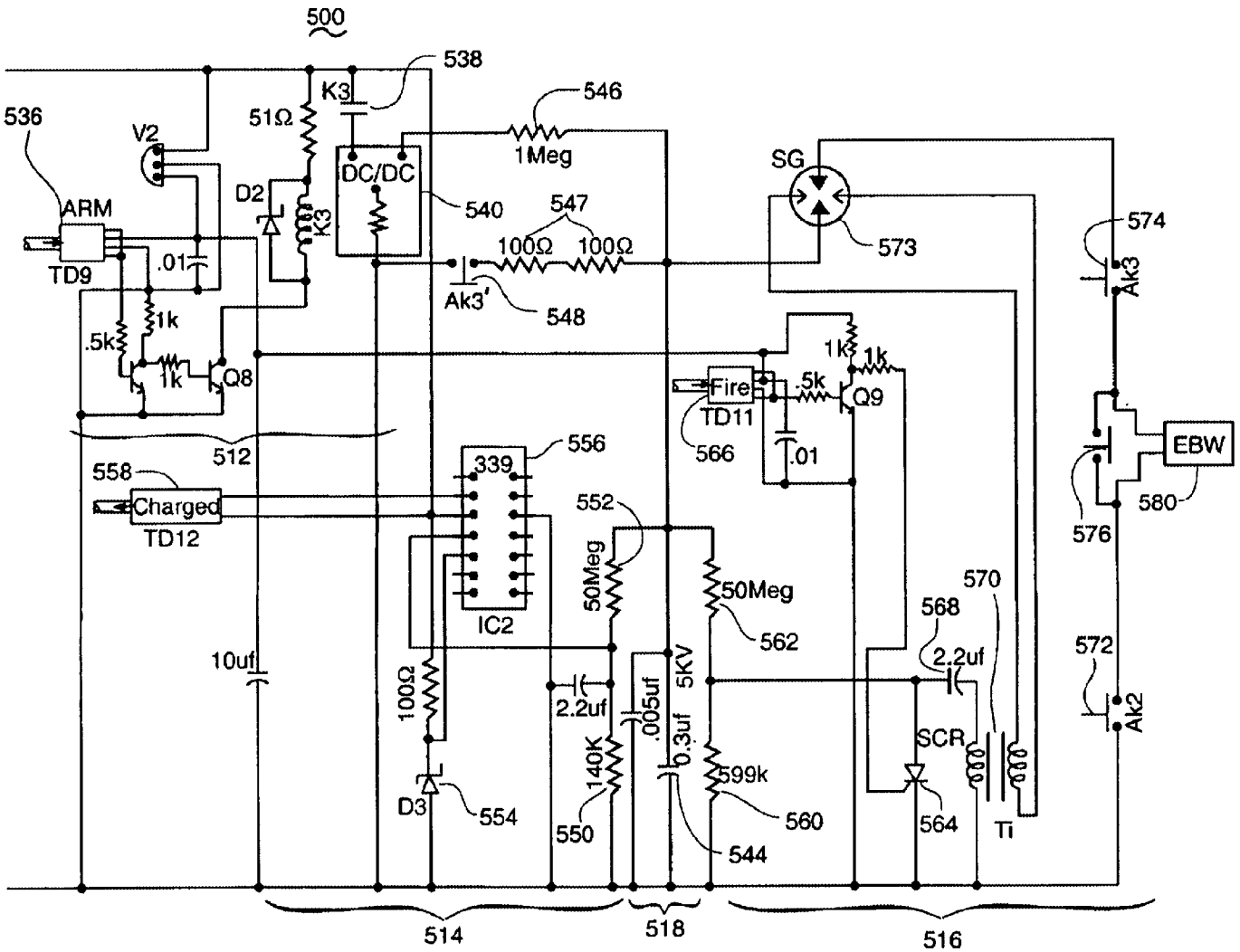
Figure 6:
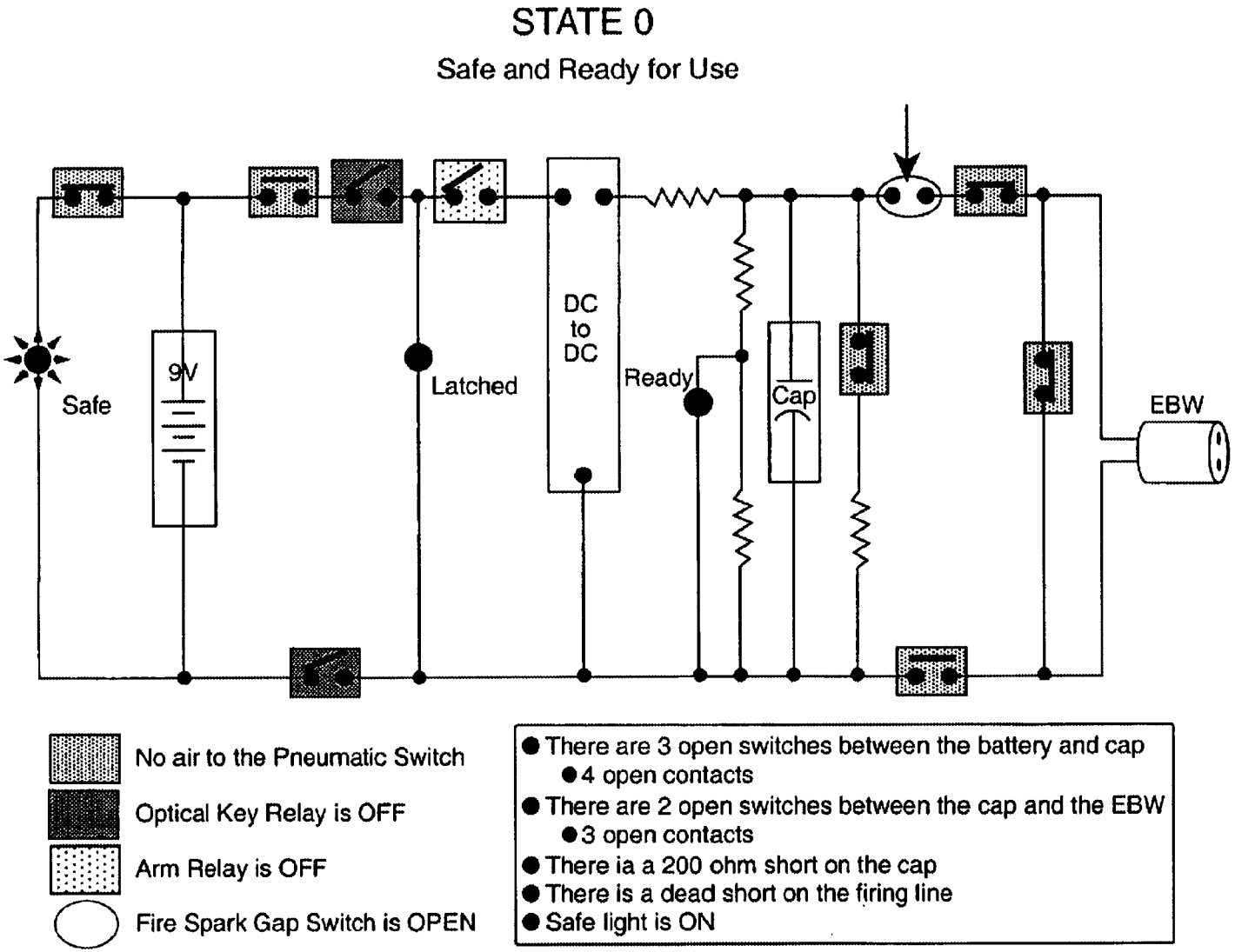
FIG. 6 shows a simplified schematic diagram of the FIG. 4 detonation-controlling module in one operating state.

Reference is made to both the FIG. 4 and FIG. 5 drawings in connection with the following specific descriptive material. The FIG. 5 drawing moreover includes the two parts identified as FIG. 5*a* and FIG. 5*b*. In the interest of brevity component identification numbers in the four hundred series and five hundred series are freely intermixed in the following discussion without drawing source figure identification, after the introductory paragraphs; the former of these numbers however appear in FIG. 4, the latter in one of the FIG. 5 drawings. The detonation-controlling module of FIG. 4 is connected with the firing module of FIG. 5 by way of six fiber optic signal paths and a parallel pneumatic tube all of which are of course non conducting with respect to the possible kilovolts of potential existing between these modules (i.e., between the modules 108 and 110 in FIG. 1) before, during and after a detonation event. While on the subject of communication links and operating potentials it may be helpful to appreciate that the connection represented at 130 in the FIG. 1 drawing is in fact a wired connection and that the firing module 108 is therefore operated at the possibly high-voltage potential of the switch elements 116 and 120. Preferably a short length of coaxial cable is used at 130 in FIG. 1 in order to exclude unwanted electrical fields including transient fields from the firing signal conducted along this same path.

FIG. 5 in the drawings therefore shows an electrical schematic diagram of a preferred firing module arrangement for the present invention. FIG. 4 shows an electrical schematic diagram of a detonation-controlling module usable with the FIG. 5 firing module. By way of a pneumatic pressure signal, three incoming optical signals and three outgoing optical signals the sub systems of the FIG. 5 apparatus are functionally coupled with the controlling and indicating elements of the controlling module in the FIG. 4 schematic diagram. Generally the FIG. 5 firing module apparatus 500 is comprised of the eight subsystems indicated at 502, 504, 508, 510, 512, 514, 516, and 518. The FIG. 4 controlling module apparatus 400 is comprised of almost the same eight subsystems indicated at 402, 404, 406, 408, 410, 412, 414, and 416. These matched subsystems achieve an orderly, safe and precisely controllable electrical initiation of the explosive-bridgewire device shown at 580 in the FIG. 5 drawing.

The FIG. 5 subsystems include the battery related apparatus at 502, the safe indicator light at 504, the optical key related apparatus at 508, the latch related apparatus at 510, the arm related apparatus at 512, the completed capacitor charge apparatus at 514, the firing apparatus at 516, and the high voltage storage capacitor at 518. The FIG. 4 subsystems include the AC to DC power supply at 402, the safe indicator light at 404, the air control valve at 406, the optical key related apparatus at 408, the latch related apparatus at 410, the arm related apparatus at 412, the completed capacitor charge apparatus at 414, and the firing apparatus at 416. These subsystems are operated approximately in the sequence recited here during a normal explosive detonating event and are therefore described in this sequence in the paragraphs following. Components used in the FIG. 4 and FIG. 5 modules are partly identified in the following paragraphs and supplementally identified in Table 2 of the appendix to the present specification. The mixture of FIG. 4 and FIG. 5 elements in Table 2 is believed desirable in view of their functional relationships and the relative ease with which the following combined description of the FIG. 4 and FIG. 5 modules can be understood.

Figure 15:
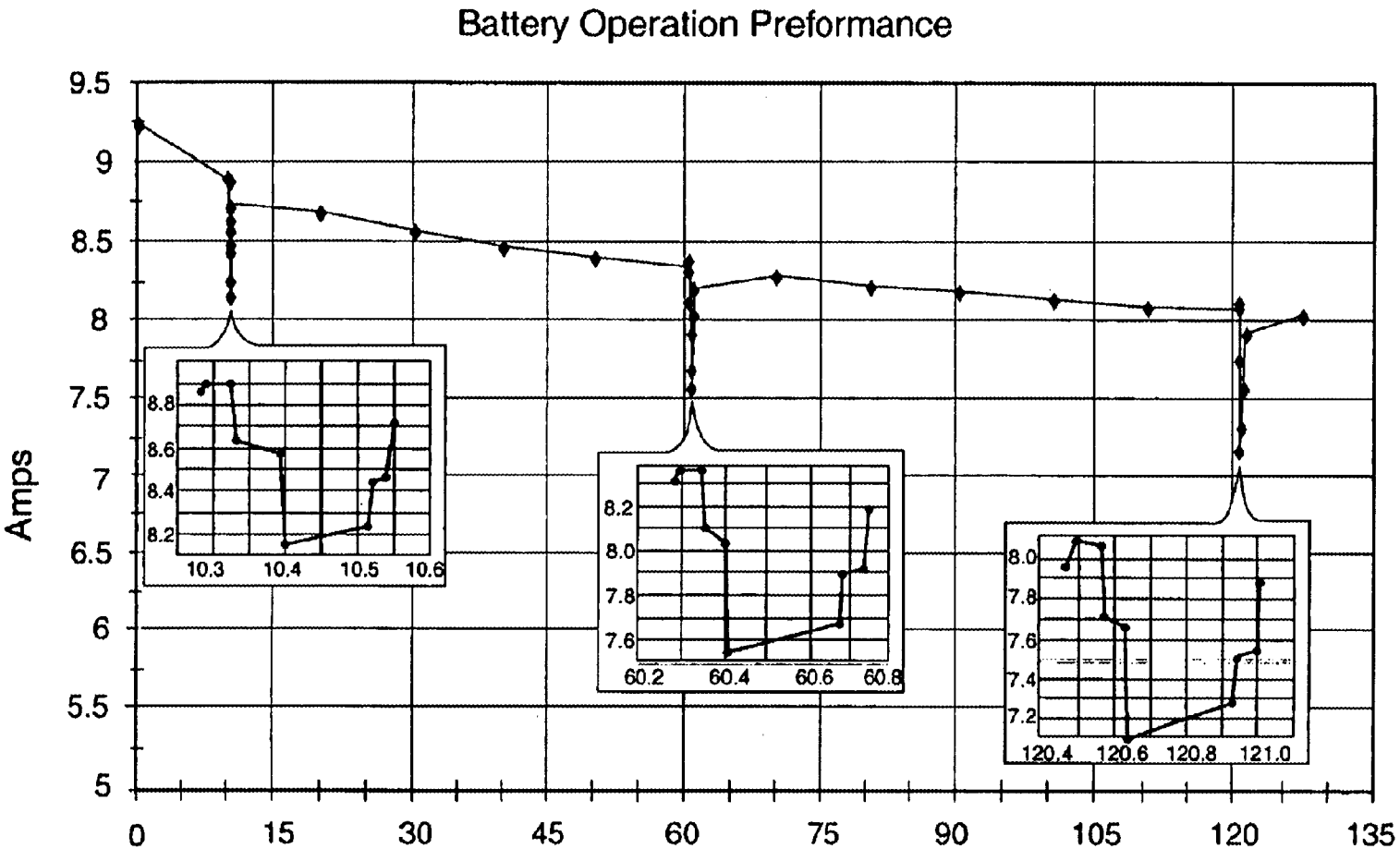
FIG. 15 shows the performance of a nine-volt alkaline battery of the Duracell® or Energizer® types over an extended two hour operating interval of the present invention firing module.
Figure 16:
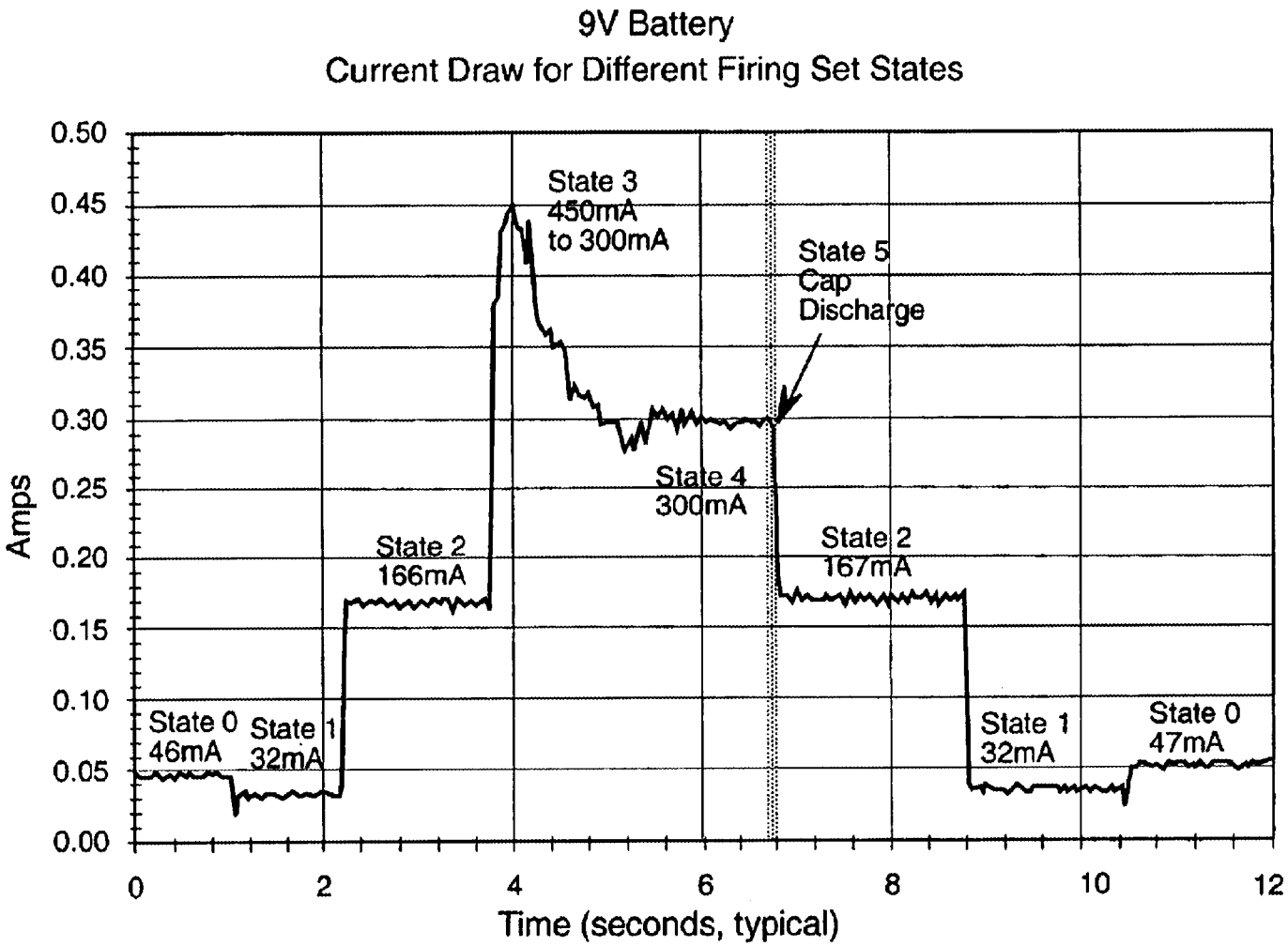
FIG. 16 shows a plot of battery voltage and current versus time for a detonation countdown interval of some twelve seconds duration using the present invention.

The battery related apparatus at 502 in FIG. 5 provides a controlled and limited duration supply of electrical energy for operating the FIG. 5 circuits and for initiating firing of the explosive-bridgewire device 580. The preferably primary battery, a fresh nine-volt alkaline transistor radio battery 517, used in this subsystem is characterized as to operating life, firing reliability and other present application characteristics in the FIG. 15 and FIG. 16 drawings herein and in the data of Table 1 in the appendix. The loading resistors at 519 in the FIG. 5 drawing serve to establish a steady supplemental load current flow of about 15 milliamperes from the battery 517 upon its installation in the firing module in preparation for a detonation event and thereby, in combination with the other FIG. 5 circuits, limit the duration of the explosive detonation-possible period in the manner described quantitatively in the FIG. 14 and FIG. 15 drawings herein. The electrolytic capacitors shown at 520 in the FIG. 5 drawing assure a low alternating current electrical impedance source is available from the battery subsystem for the remaining FIG. 5 circuitry.

Figure 17:
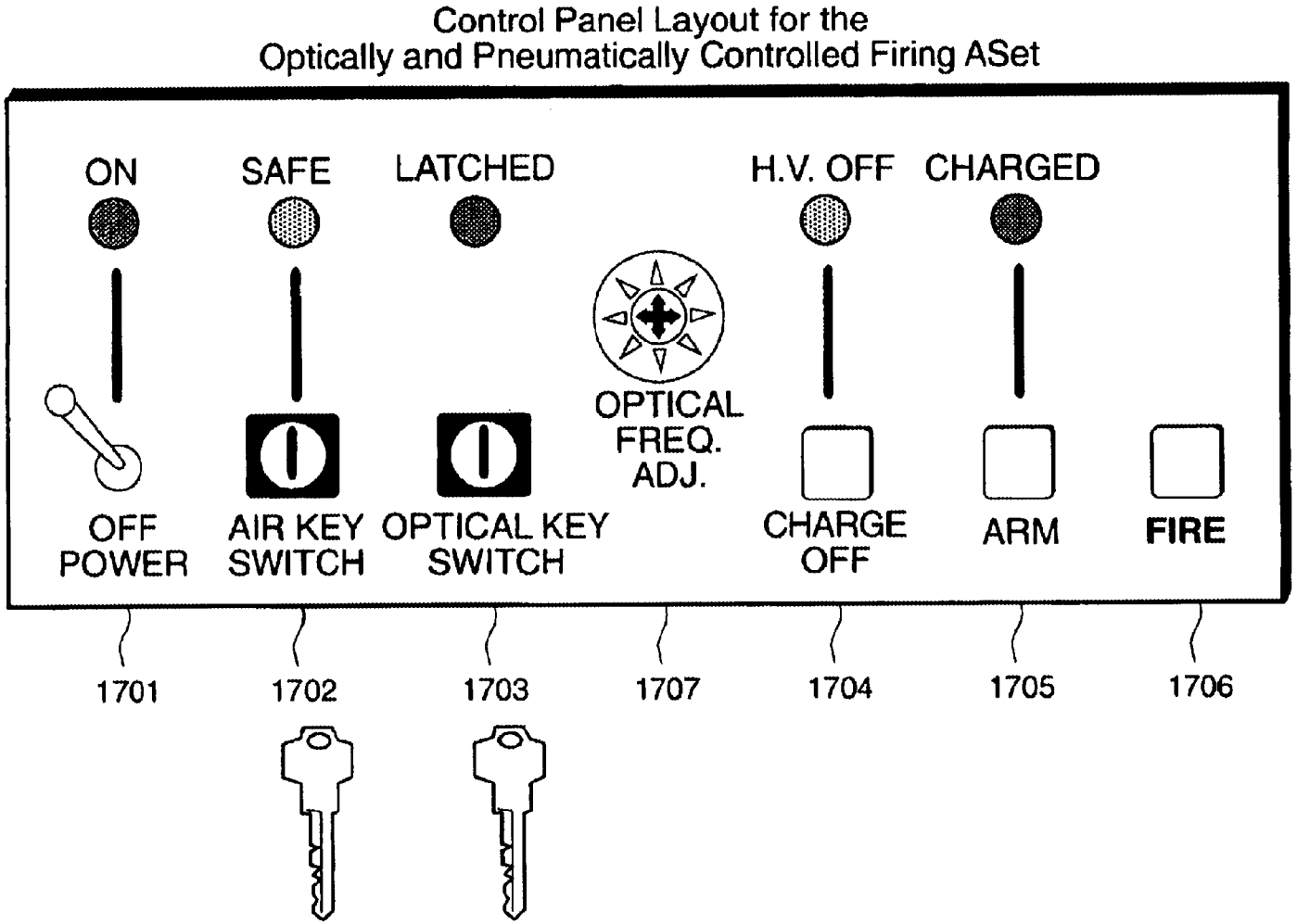
FIG. 17 shows an enlarged view of a detonation-controlling module control panel usable with the present invention.

Once a new battery has been installed at 517 in the FIG. 5 system, and power switch 418 in FIG. 4, i.e., switch 1701 in FIG. 17, is on and the "Air Key Switch" 430 in FIG. 4, i.e., switch 1702 in FIG. 17, is off, the firing module circuits remain in the quiescent state shown in the FIG. 5 drawing with the normally closed pneumatic air key switch contacts 524, AK1' closed. In this state a "safe" signal is communicated along the first fiber optic signal path from the FIG. 5 firing module transmitting transducer 522 (TD8 etc) back toward the detonation-controlling module receiving transducer 420 of FIG. 4 and the "safe" control panel green light emitting diode 422 is thus illuminated. Upon closure of the FIG. 4 air key control at 430, 1702 in FIG. 17, the AK1' contacts In FIG. 5 open removing this transducer 522 signal and its energy as received in the receiver transducer 420 of FIG. 4; this extinguishes the safe signal emitted by the FIG. 4 light emitting diode 422. The transistors 424 and 426 provide amplification of the transducer 420 electrical signal up to a level sufficient to operate the light emitting diode 422.

The transducers 420 and 522 and the similar other components discussed herein are preferably embodied as devices described in the Hewlett Packard Company "Isolation and Control Components Designer's Catalog" under the heading of "Versatile Link" "The Versatile Fiber Optic Connection", a catalog identified with the numbers 5965-1657E. More precisely the family of devices identified as the HP "HFBR-0501 Series" of fiber optic components may be used for these present purposes. These devices operate in the 660-nanometer spectral range, over a plurality of selectable data rates, separation distances and fiber optic conductor types. Identification of specific transducers from the HFBR-0501 Series appears in Table 2 herein. This Hewlett Packard Company data is hereby incorporated by reference herein.

Manual operation of the control panel air key switch next closes the electrical contacts 430 in a detonation initiating sequence; this closure is achieved by way of air valve 428 accomplishing pneumatic pressurization of the plastic tubing member disposed in parallel with the fiber optic signal paths connecting the firing module 500 with the detonation controlling module 400. In the FIG. 5 firing module, pneumatic pressurization causes position changes of both the normally closed and normally open air key switch contacts at 524 and 526 along with position change of the four crowbar and series AKS contacts (548, 572, 574, 576) shown in connection with the energy storage capacitor 544 and the explosive-bridgewire device 580 in the right-most portions of the FIG. 5 drawing. Closure of the air key switch contact 526 applies energy from the nine volt battery 517 to the optical key portion 508 of the FIG. 5 circuitry as well as causing an opening of the air key switch contacts 524 and removal of the safe fiber optic signal between transducers 522 and 420. As may be appreciated from the functional discussion below, the air key switch actuated by the FIG. 4 valve 428 may be regarded as an overall safety feature of the present invention; regardless of other events including misuse of the control panel inputs, no detonation of the explosive-bridgewire device 580 is possible until the air key switch valve is operated.

Closure of the air key switch contact 430 also applies five volts direct current energy from the power supply 419 to other portions of the FIG. 4 circuitry including the optical key circuitry shown at 408. The closure of the "Optical Key Switch" at 433 in FIG. 4 (switch 1703 in FIG. 17), results in the generation of a pulse modulated optical key switch signal at the OKS transducer 431. This signal is received via a second of the fiber optic signal paths at the transducer 528 in FIG. 5 and initiates additional FIG. 5 circuitry, the optical key circuits identified at 508. Pulse modulated signal are used between the circuits 408 and 508 in the interest of safety, it being considered unlikely that any interfering signal, electrical or optical, received in the circuitry 508 can duplicate the intended pulse frequency of 10 kHz and thus falsely continue a FIG. 5 "countdown" sequence. Pulse modulation of the signal emitted by transducer 431 is achieved by the type 832 integrated circuit device 434 and the associated discrete timing components all as indicated at 432. These components include a control panel-mounted timing adjustment potentiometer 1707 as also appears in the components 432 in FIG. 4. Decoding of the received pulsed optical signal is achieved by another type 832 integrated circuit 530 and its associated discrete timing components appearing in FIG. 5.

Successful receipt and decoding of the transmitting transducer 431 optical signal results in closure of the K2 relay 532 and battery 517 energizing of additional parts of the FIG. 5 circuits. These circuit including the "latch" transmitting transducer 534, energized by way of the double K2 contacts at 531 and 533. The "latch" optical signal is received via the third fiber optic signal path at the receiver transducer 435 of latch circuits 410 and results in energization of the red "latched" light emitting diode 436 on the detonation-controlling module control panel. This energization occurs by way of a discrete transistor amplifier of the type described above in connection with the circuits 404.

Once the FIG. 4 circuits are in this "latched" condition a manual closure of the next switch in the "countdown" sequence, the "arm" switch at 438, switch 1705 in FIG. 17, causes emission of another optical signal along the fourth fiber optic signal path by the transmitting transducer 440 and reception of this signal at the transducer 536 in the FIG. 5 firing module circuits. In the detonation-controlling module, closure of the "arm" switch 438 also closes relay K1 which latches in the closed condition by way of the K1 contact at 449. A second K1 contact at 439 keeps the "arm" transducer 440 "on" while the K1 relay is latched. A third K1' contact at 442 opens with this event thus removing the green light emitting diode 444 "high voltage off" signal from the control panel. Latching of the relay K1 is terminated by either a manual depression of the normally closed control panel "charge off switch", 445 (switch 1704 in FIG. 17), or by depression of the "fire" switch that has a normally closed contact at 447 (switch 1706 in FIG. 17).

Reception of the fiber optic "arm" signal at the transducer 536 closes relay K3 in the FIG. 5 firing module circuits by way of another discrete two-transistor amplifier of the type used at 404 in FIG. 4, an amplifier including the transistor Q8. Closure of relay K3 closes the K3 contact at 538 and thereby applies battery 517 energy to the DC-to-DC converter circuit 540 and commences the kilovolt charging of detonation energy storage capacitor 544 by way of the current limiting resistance 546. Resistance 546 limits the initial inrush current to capacitor 544 and also limits the short circuit current demand from DC to DC converter circuit 540 in the event of inadvertent failure to open (or intentional safe abort reapplication of the air key switch and the closed high-voltage crowbar contacts 548.

In order to inform the system operator when the charging of energy storage capacitor 544 has reached a voltage level sufficient to assuredly detonate the explosive-bridgewire element 580 a voltage sensing circuit as indicated generally at 514 in FIG. 5 is provided. When the voltage at the junction of resistors 550 and 552 reaches the level of the Zener diode 554 the type 339 quad comparator circuit at 556 changes output state and sends a "charged" optical signal from the transmitting transducer 558 via the fifth fiber optic signal path to the detonation-controlling module receiver transducer 446 to illuminate the red light emitting diode 448. A capacitor voltage level above 1640 volts has been found suitable for this detonation of the explosive-bridgewire device identified in the components table, Table 1, of the present specification.

The additional voltage divider circuit comprised of resistors 560 and 562 connected with capacitor 544 in the firing circuits at 516 is used to charge a small capacitor 568 from the energy applied to capacitor 544. The energy from this capacitor 568 is applied through the step-up pulse transformer 570 to the spark gap switch 572 to thereby initiate an arc in the switch 572 and thus dump the capacitor 544 energy into the explosive-bridgewire device 580. These actions occur upon receipt of a "fire" command from the FIG. 4 transmitting transducer 450. The "fire" command is initiated by operator closure of the "fire" switch contact at 452 and is transmitted via the sixth fiber optic signal path between detonation-controlling module and firing module. The receiving transducer 566 and its transistor amplification circuit feed the trigger signal to the SCR 564 which discharges capacitor 568 through the pulse transformer 570 to spark gap switch 573. Use of energy tapped from capacitor 544 to initiate the firing sequence is a further assurance of the capacitor 544 having reached a sufficient level of charge to be successful in firing the explosive-bridgewire 580 prior to an actual firing event. Table 1 and FIGS. 14 and 15 herein provide more specific data with respect to typical explosive-bridgewire device firing requirements.

With regard to additional safety features included in the FIG. 4 and FIG. 5 apparatus note that either one of a manual election to abort a previously counted-down explosive-bridgewire detonation event through opening the "charge off switch" contacts at 445 or a manual opening of the "fire" switch contacts at 447 with a firing event causes release of the latched condition of relay K1 in the FIG. 4 detonation-controlling module diagram and return of the system to an unarmed state. Note also that a manual reclosure of the air key switch will not only open the air key switch serial contacts at 572 and 574 and close the high-voltage crowbar contact 576 (both in prevention of explosive-bridgewire firing) but also close the capacitor crowbar contact at 548 and thereby discharge the capacitors 544 and 568 to zero or below the SCR 564 trigger level (via the two hundred ohms of series resistance at 547), remove the "charged" signal transmitted by the transmitting transducer 558 and thus additionally preclude a firing event.

Figure 12:
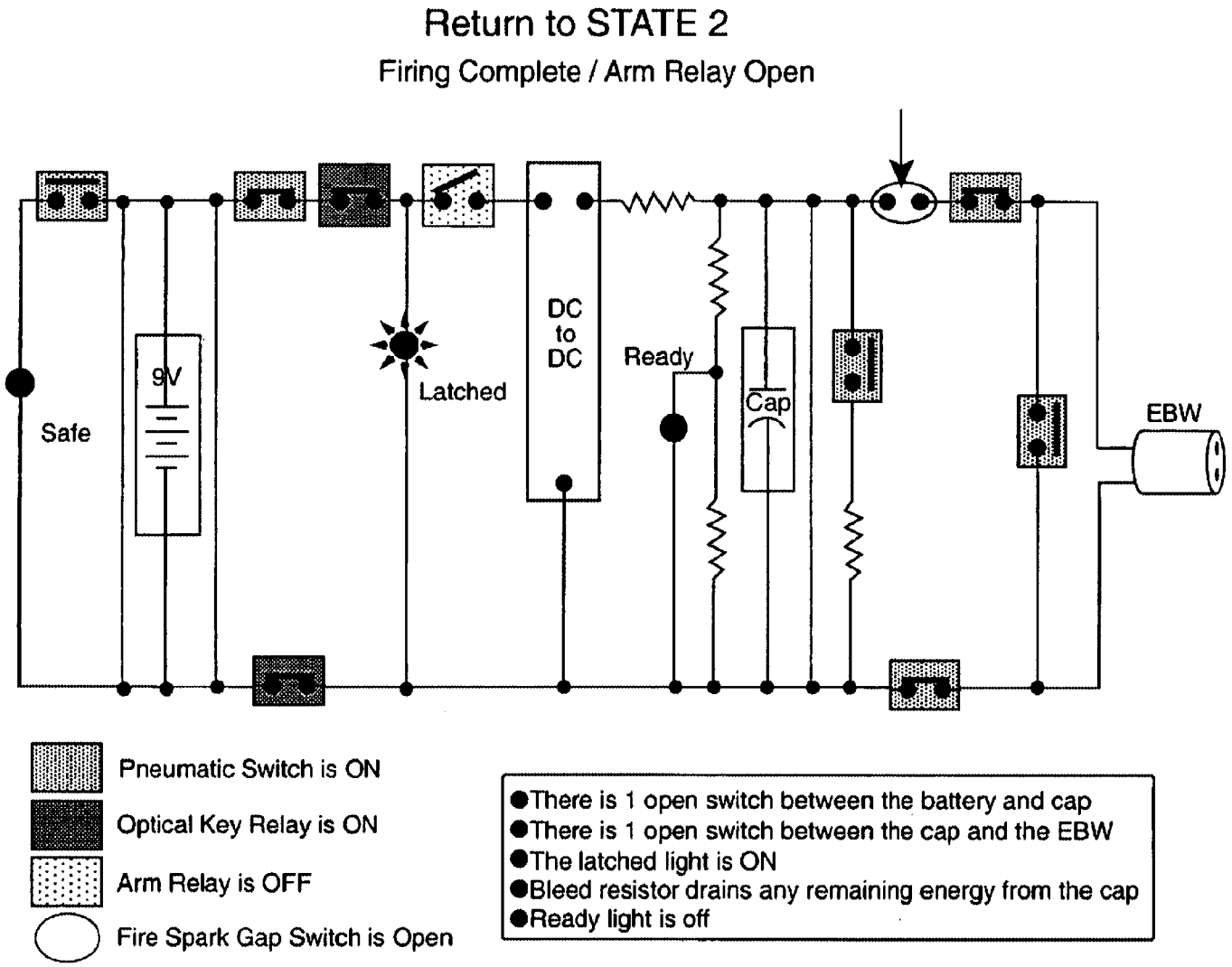
FIG. 12 shows a simplified schematic diagram of the FIG. 4 detonation-controlling module in another operating state.
Figure 13:
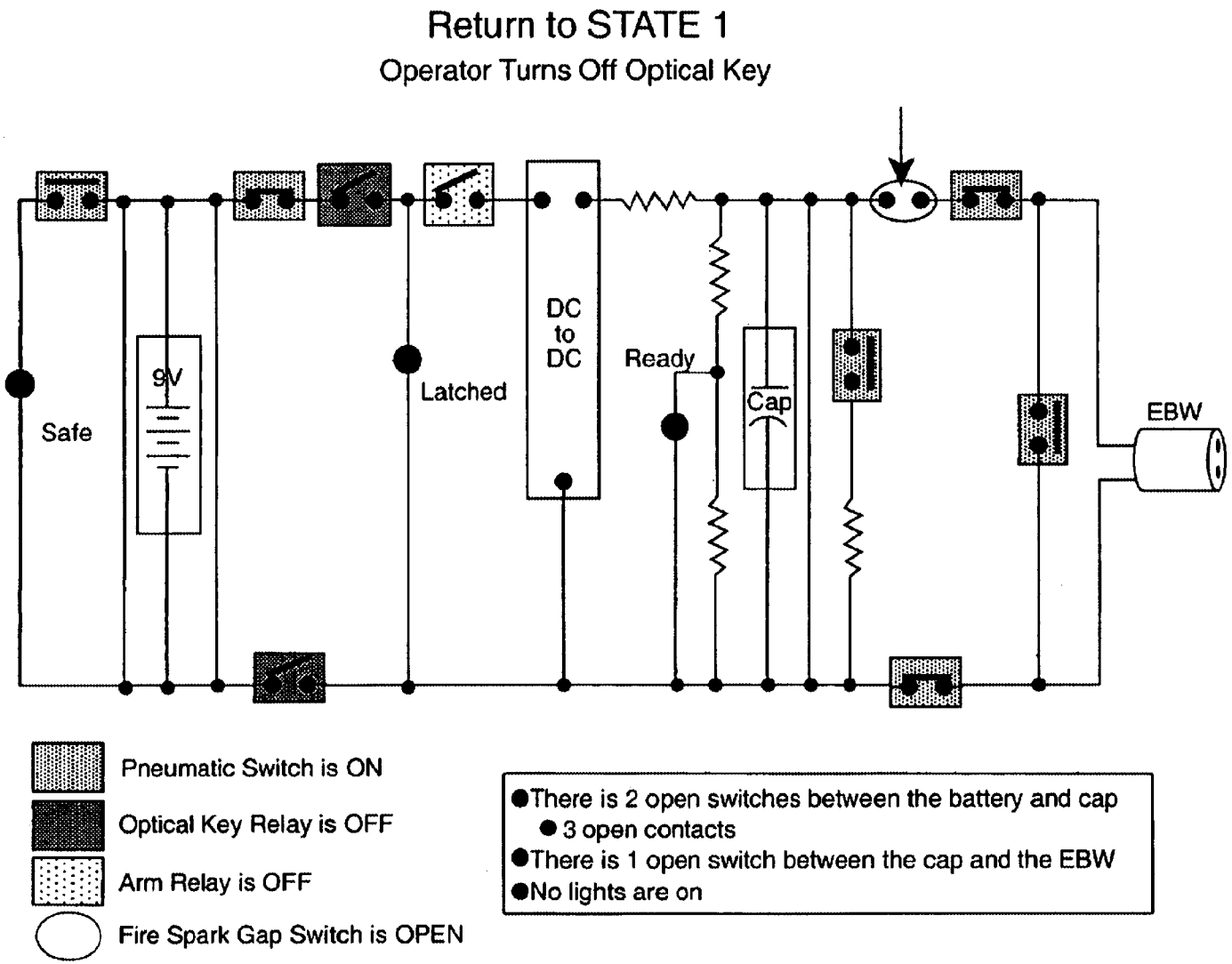
FIG. 13 shows a simplified schematic diagram of the FIG. 4 detonation-controlling module in another operating state.
Figure 14:
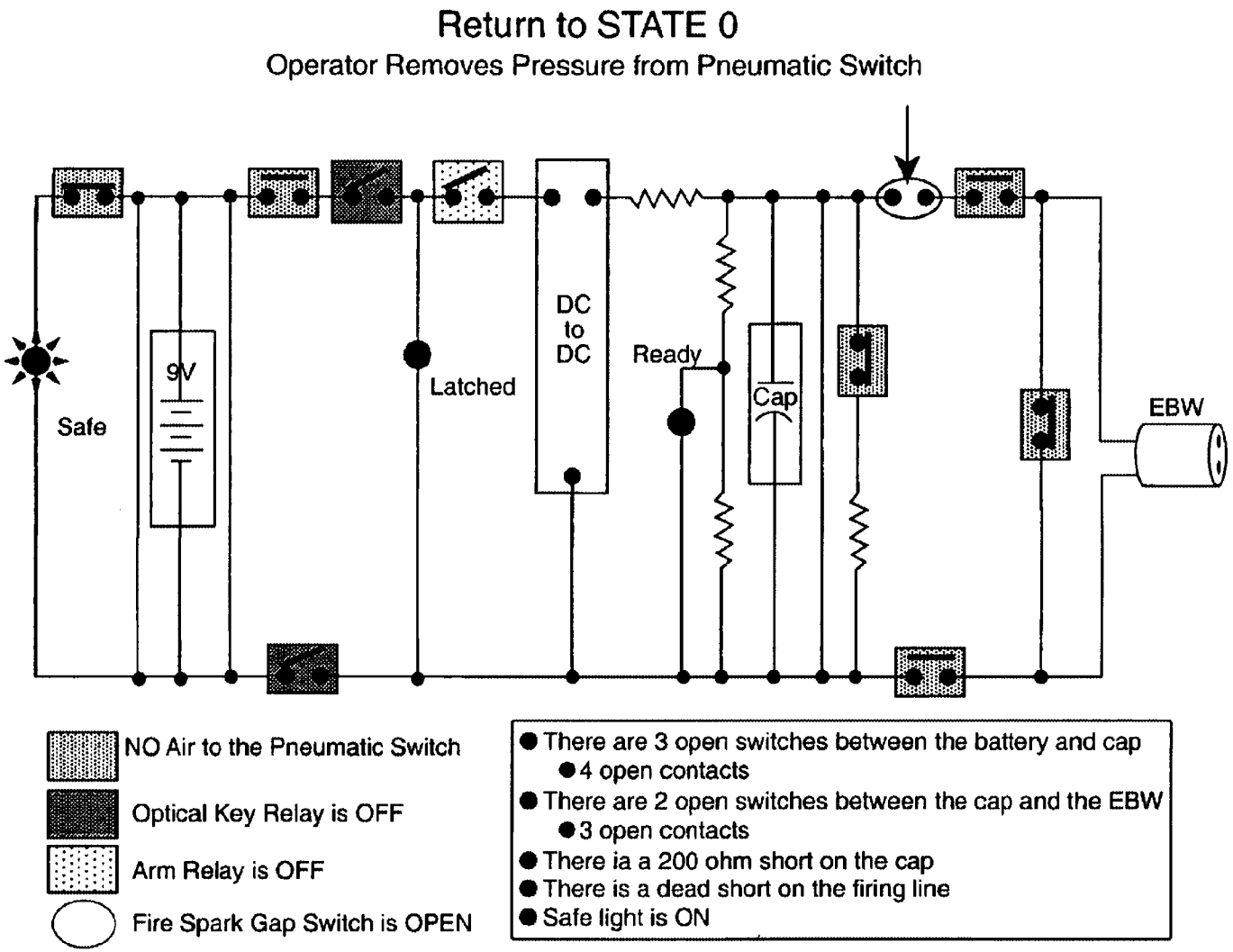
FIG. 14 shows a simplified schematic diagram of the FIG. 4 detonation-controlling module in another operating state.

FIG. 6 through FIG. 14 in the drawings show simplified operational schematic versions of the FIG. 5 firing module circuit in which details appearing in the FIG. 5 drawing are omitted for clarification and ease of understanding. Each of these drawings relate to a different operating state of the FIG. 5 circuit as described above and therefore show the several switches, indicator lamps and other details of the FIG. 5 apparatus in the status they attain during the respective states of circuit operation. The legends appearing below each of the FIG. 6 through FIG. 14 drawings summarize on the left the status of the switches and other components shown in that drawing, and summarize on the right the detonation safety features operative in the illustrated state. By way of clarification of the FIG. 6 through FIG. 14 drawings the "safe", "latched" and "charged" lights shown in these drawings may be regarded as representations of the fiber optic transmitters identified at 522, 534 and 558 in FIG. 5 in order to maintain the principle that these drawings represent only firing module circuits. If these lights are viewed as representing control panel lamps then theoretically the FIG. 6 through FIG. 14 drawings are simplified composite drawings representing portions of both the FIG. 4 and FIG. 5 schematic diagrams. Firing of the explosive-bridgewire 580 is represented in simplified schematic form in the FIG. 11 drawing. The later drawings in the FIG. 6 through FIG. 14 group, i.e., the drawings of FIG. 12 through FIG. 14 represent states of the FIG. 5 circuit apparatus occurring after a explosive-bridgewire firing event, i.e., states involved in the return of the circuit to one or more possible quiescent conditions.

OPERATION

As shown in the drawings of FIG. 4 through FIG. 14 and in FIG. 17 herein there are five detonation-controlling module or control module inputs that must be "on" or "activated" for the firing module to initiate an explosive-bridgewire device. First, of course, the control console's AC power must be turned on. This switch, 418 in FIG. 4, is nothing more than an interrupt of the control module's 120 Volt AC power line. This switch does not immediately affect the firing module in any way; it only initially allows the control module to begin interrogation (or sensing) of the "safe" status of the firing module. Thus, when the control module is "powered on," the "safe" LED on the control module illuminates, having sensed this state of the firing module through positive-logic on one of the fiber-optic lines. This positive-logic "safe" feedback signal from the firing module indicates that battery power is available, but is disconnected from all other parts of the firing module circuitry through the "fail-safe" operation of the multi-pole air key switch or pneumatic switch in the firing set. The firing module is said to be in state 0.

Figure 7:
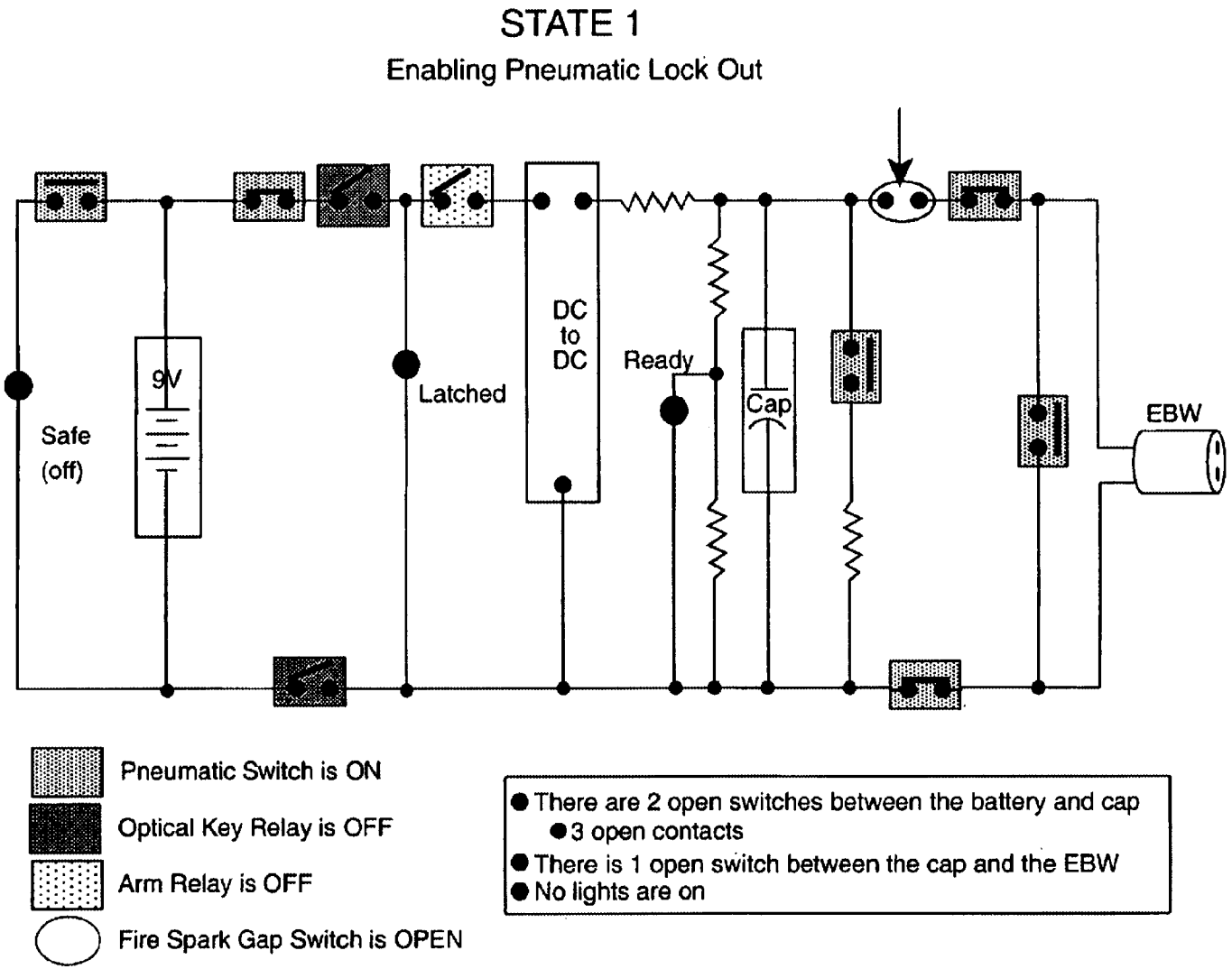
FIG. 7 shows a simplified schematic diagram of the FIG. 4 detonation-controlling module in another operating state.

Subsequently, in state 1, as shown in the FIG. 7 drawing herein an "enabling the pneumatic lock out," by the operator turns on the air key switch. At this time sufficient pressure is applied to the pneumatic tube at the detonation-controlling module end. This pressure is transmitted through the pneumatic tube from the detonation-controlling module to the firing module. This pressure activates the spring-loaded (fail-safe) air key switch in the firing module. The air key switch performs several functions in the firing module. First, it removes the "safe" feedback signal (one of the three fiber-optic return lines) from the firing module to the control module; this turns off the "safe" LED on the control module and indicates power has been applied to the optical key sensing circuitry (and associated relay) in the firing module. Additionally, the pneumatic switch removes the short-circuits on the high-voltage capacitor's output and on the explosive-bridgewire input, and connects both leads of the explosive-bridgewire to the high-voltage energy storage capacitor 544 through the high voltage spark gap switch 573.

Figure 8:
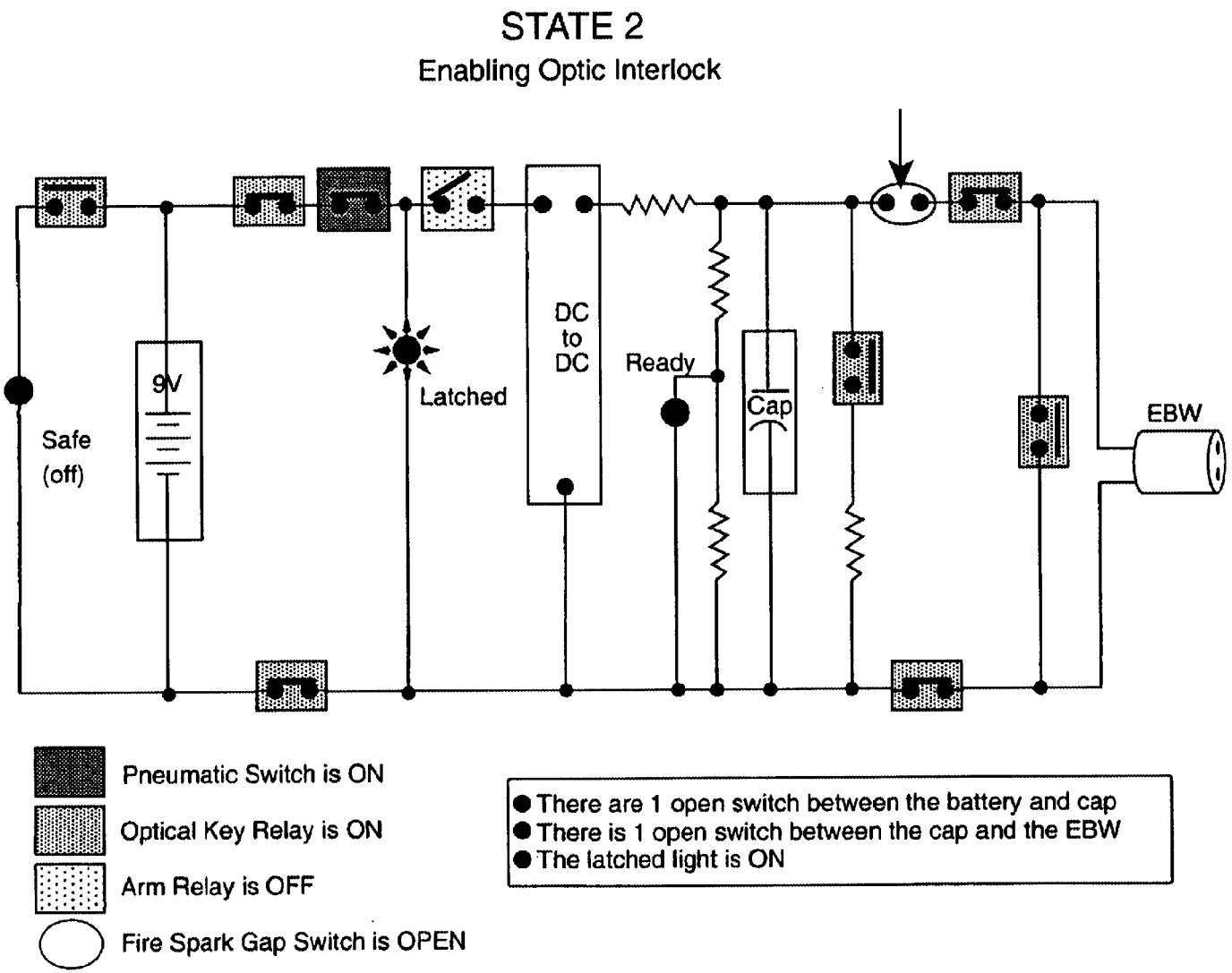
FIG. 8 shows a simplified schematic diagram of the FIG. 4 detonation-controlling module in another operating state.
Figure 9:
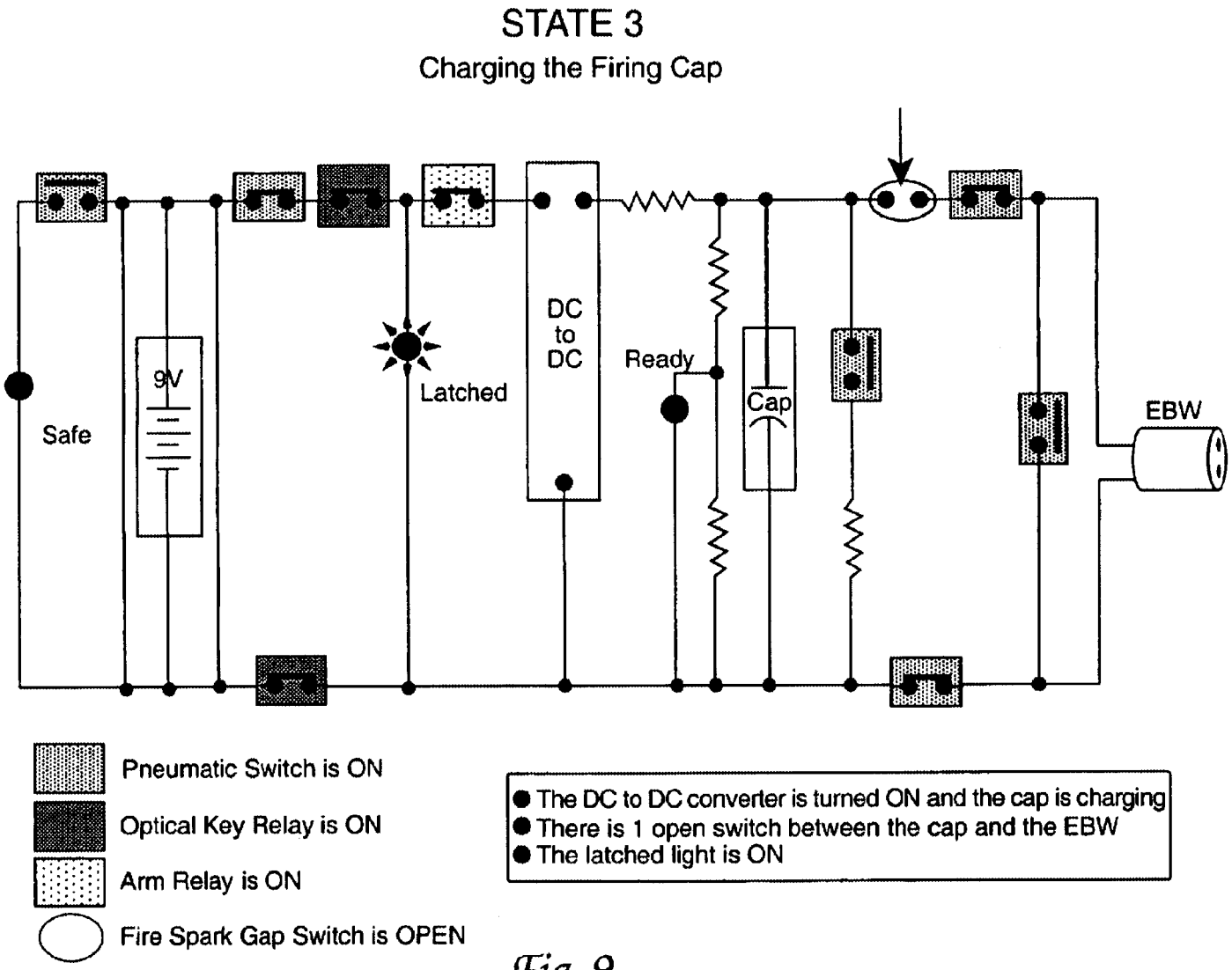
FIG. 9 shows a simplified schematic diagram of the FIG. 4 detonation-controlling module in another operating state.
Figure 10:
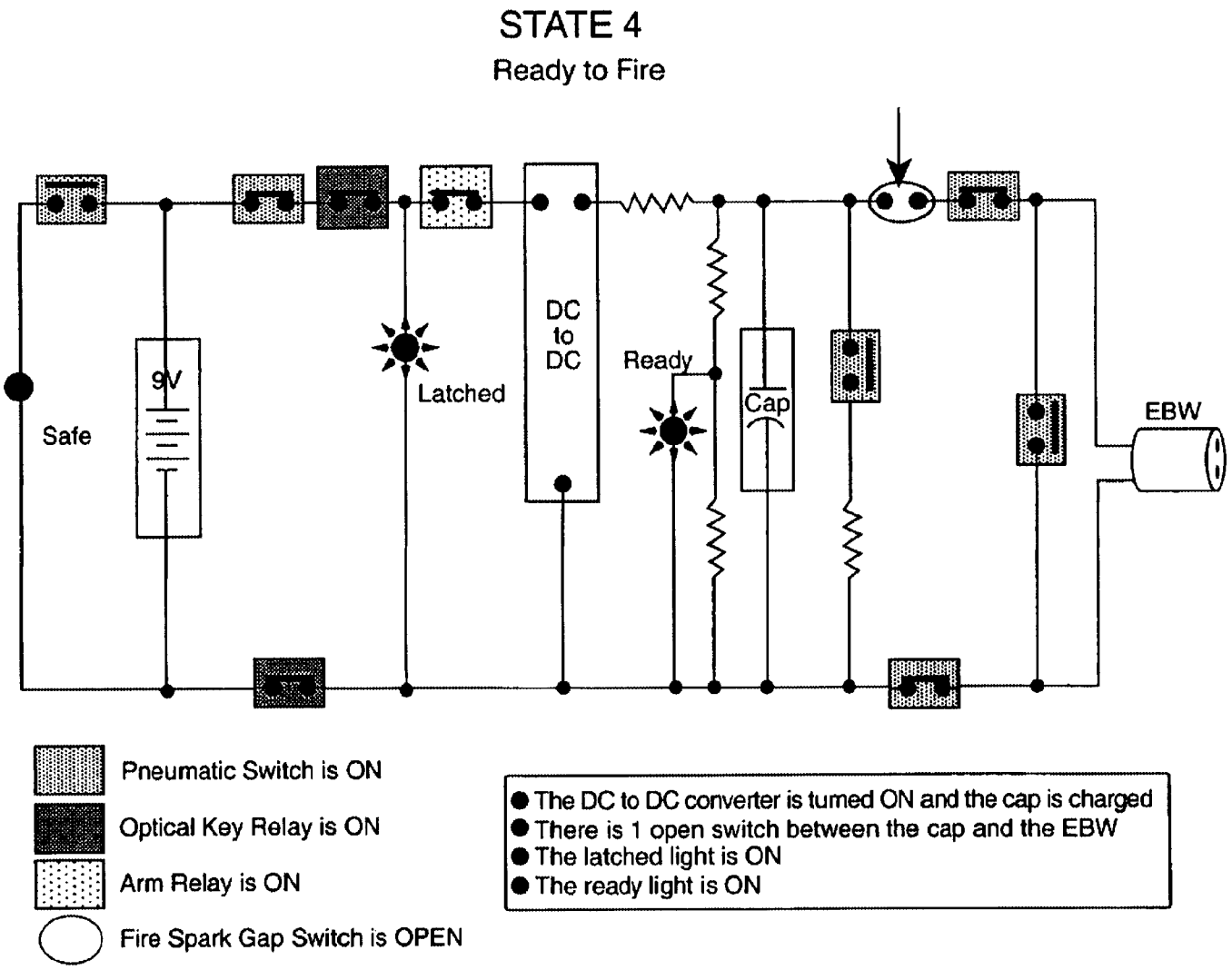
FIG. 10 shows a simplified schematic diagram of the FIG. 4 detonation-controlling module in another operating state.
Figure 11:
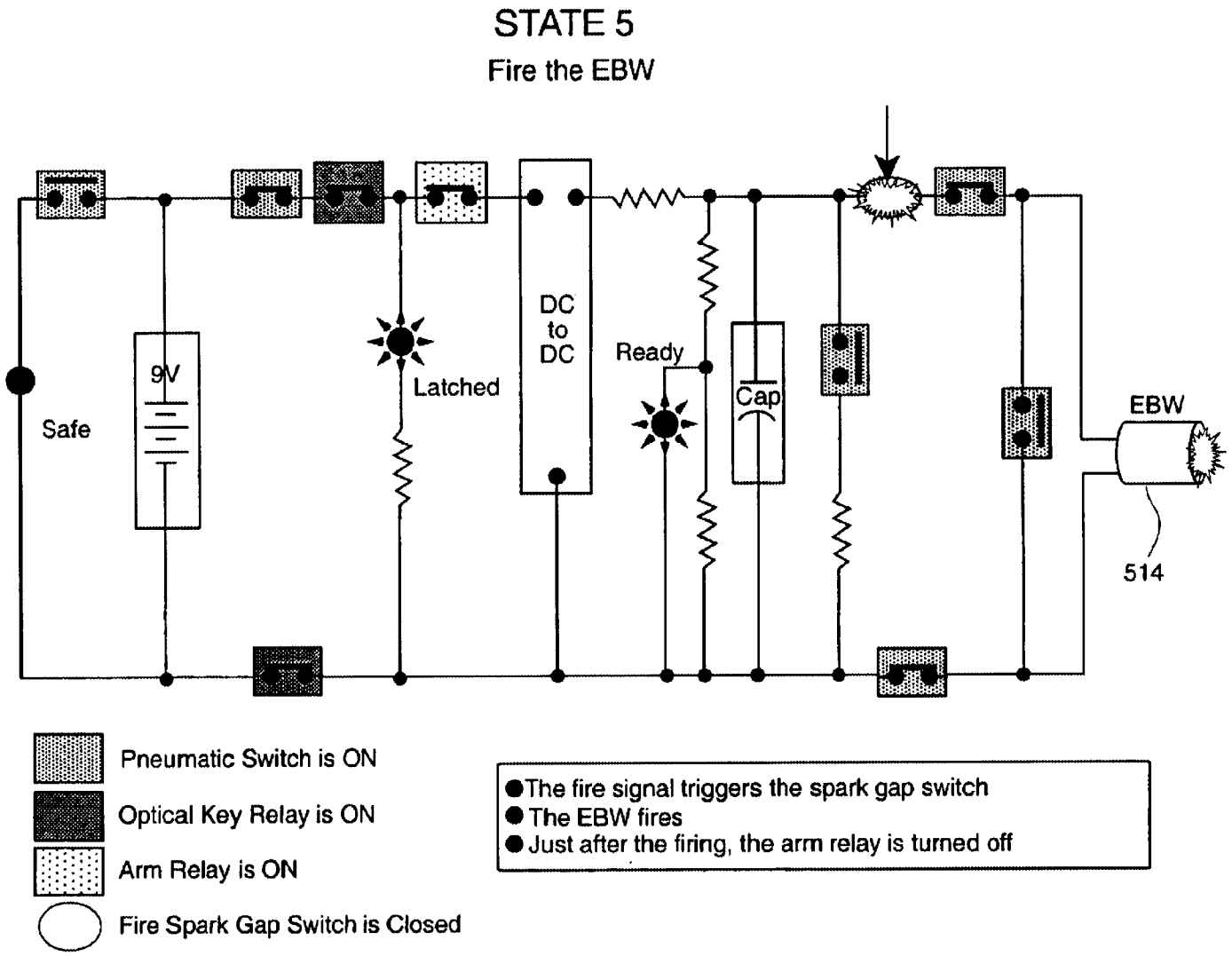
FIG. 11 shows a simplified schematic diagram of the FIG. 4 detonation-controlling module in another operating state.

In the next state, state 2, as represented in the FIG. 8 drawing an "enabling the optic interlock" occurs. In this state the operator turns "on" the "optical key switch" on the control module. This sends an optical square-wave signal to the firing module at a selected frequency that can be adjusted through the "optical frequency adjust" potentiometer, 1707 in FIG. 17, on the face of the control module. When the frequency-selective detector circuit (energized in state 1) in the firing module senses this signal, it energizes a relay 532 that directly connects both poles of the battery power to additional firing module circuitry. This circuitry consists of the diagnostic and communication electronics needed in the charging state. (For example, high-voltage capacitor voltage level sensor circuitry, and high-voltage switch control circuitry.) The power to the DC-DC converter is not yet applied. At this time, the "latching" relay sends a fiber-optic signal back to the control module where the control module illuminates the "latched" LED. At this point also there is only one electrical connection (the arming relay) preventing the DC-to-DC converter from charging the high-voltage capacitor.

In the next detonation-controlling module state, state 3, the operator presses the momentary-contact "ARM" button on the control module. Although this is a momentary switch, it latches closed by way of a K1 relay contact and keeps the "ARM" line optically energized until it is interrupted by a "charge off" or "fire" command received at one of the normally closed switches 445 and 447, respectively. The "HV Off" LED on the control module is turned "off" to show that the high-voltage circuitry on the firing module has been energized. At this point, in the firing module, the battery is finally connected through one switch, 526, and three relay contacts 531, 533, and 538 to the DC to DC converter. The high-voltage capacitor 544 used to fire the explosive-bridgewire is thereby caused to charge. Since the explosive-bridgewire has minimum current and rate-of-rise-of-current requirements, it is necessary to disallow firing of the explosive-bridgewire until the capacitor has charged to a sufficient level. It has been elected to provide feedback to the operator as to when the capacitor 544 is sufficiently charged as opposed to locking out the operator's command until sufficient charge is attained.

When the capacitor 544 charges to the minimum level, circuitry within the firing module senses this, and sends a "charged" fiber-optic signal back to the control module at which time the control module illuminates the "charged" LED. This is state 4. The firing module is then ready to fire the explosive-bridgewire. (Notice that, so far, the "Charge Off" control button, just next to the "ARM" button has not used. This button is used only for detonation abort operations.) While the main high-voltage capacitor is charging, a smaller capacitor 568 in the firing module also charges. When the "fire" button is pressed, this smaller capacitor 568 is connected (through a silicon controlled rectifier and high-voltage pulse transformer) to the high-voltage gap switch 573 used to directly connect the high-voltage capacitor 544 to the explosive-bridgewire.

In state 5, "Fire the EBW," as described above, the small capacitor 568 is discharged through a pulse transformer 570 and SCR 564 to initiate the breakdown of a high-voltage gap switch 573 that directly connects the capacitor 544 to the explosive-bridgewire. When the "fire" button is pressed on the control module, the "ARM" signal is also removed and charging of the capacitor 544 ceases. This eliminates possible multiple firings of the explosive-bridgewire. With the removal of the arm signal, the firing module circuit is returned to state 2 thus disconnecting power from the step-up DC to DC converter 540.

Next, the operator removes the optical key in the control module and this returns the firing module to state 1. Finally, the operator removes the key from the air key switch and thereby returns the firing set to state 0 or the "safe" state.

While the apparatus and method herein described constitute a preferred embodiment of the invention, it is to be understood that the invention is not limited to this precise form of apparatus or method and that changes may be made therein without departing from the scope of the invention which is defined in the appended claims.

We claim:

1. The abortable and safe method of explosively disintegrating an assembly, operating at elevated electrical potential with respect to a surrounding environment, into small portions, said method comprising the steps of:

joining portions of said elevated electrical potential assembly in a local explosive material-detonation responsive manner;

locating an electrically initiateable charge of explosive material adjacent said portions of said elevated electrical potential assembly;

disposing a quantity-limited depletable source of explosive material-detonation initiating electrical energy adjacent said charge of explosive material, said quantity-limited source of explosive material-detonation initiating electrical energy being also disposed at said elevated electrical potential with respect to said surrounding environment;

connecting said quantity-limited source of explosive material-detonation initiating electrical energy with said electrically initiateable charge of explosive material via a wired conductor path inclusive of a coded optical energy responsive electrical switching network;

said quantity-limited-depletable source of explosive material-detonation initiating electrical energy, said wired conductor path, and said coded optical energy responsive electrical switching network comprising an explosive material firing module;

coupling said firing module coded optical energy responsive electrical switching network to a detonation controlling module via a multiple parallel path fiber optic optical energy signal transmission apparatus;

said multiple parallel path fiber optic optical energy signal transmission apparatus being also electrically non conducting with respect to said elevated electrical potential of said assembly;

defining, within said detonation controlling module, a successive sequence plurality of detonation controlling module and firing module operating states including an initial off state, a final state initiating detonating of said electrically initiateable charge of explosive material and a plurality of intermediate operating states;

communicating optical signals indicative of existence of selected of said detonation controlling module operating states between said detonation controlling module and said firing module coded optical energy-responsive electrical switching network via said multiple parallel path fiber optic optical energy signal transmission apparatus;

communicating optical signals indicative of existence of selected of said firing module operating states between said firing module and said detonation controlling module via said multiple parallel path fiber optic optical energy signal transmission apparatus;

including manually electable operating state termination inputs in said detonation controlling module, said manually electable operating state termination inputs enabling premature, and non detonating of said explosive material, terminating of a selected plurality of said intermediate states in said detonation controlling module and said firing module;

said quantity-limited depletable source of explosive material initiation electrical energy enabling duration prediction of a detonation energy available possible detonating of said explosive material and commencement of an ensuing remainder period of insufficient detonation energy available and safe manual manipulation of said explosive material; and initiating detonation of said explosive material upon transition through a selected plurality of said detonation controlling module and firing module operating states.

2. The abortable and safe method of explosively disintegrating an assembly of claim 1 wherein said method further includes the step of:

enabling detonation of said explosive material from a manually operated pneumatic control input of said detonation controlling module;

said enabling detonation step including pressurizing a pneumatic pressure conduit path of said multiple parallel path fiber optic optical energy signal transmission apparatus;

said pressurizing of a pneumatic pressure conduit path including pressurizing an electrical crowbar actuation element in said firing module and thereby removing a shunt connection across an electrical input port of said electrically initiateable charge of explosive material.

3. The abortable and safe method of explosively disintegrating an assembly of claim 2 wherein said step of disposing a quantity-limited depletable source of explosive material-detonation initiating electrical energy adjacent said charge of explosive material includes locating an electrical battery of selected electrical capacity in said firing module adjacent said charge of explosive material.

4. The abortable and safe method of explosively disintegrating an assembly of claim 3 wherein said step of disposing a quantity-limited depletable source of explosive material-detonation initiating electrical energy in said firing module further includes the step of:

charging an energy storage capacitor also located in said firing module from energy stored in said electrical battery; and said step of charging an energy storage capacitor includes charging said capacitor to a high voltage from said battery with a DC to DC converter circuit.

5. The abortable and safe method of explosively disintegrating an assembly of claim 4 wherein:

said step of enabling detonation of said explosive material from a manually electable pneumatic control input of said detonation controlling module comprises a first of said plurality of intermediate operating states;

enabling of said coded optical energy responsive electrical switching network comprises a second of said plurality of intermediate operating states;

said steps of charging an energy storage capacitor located in said firing module from energy stored in said electrical battery to a high voltage comprise a third of said plurality of intermediate operating states; and a step of sensing successful attainment of a selected level of charge in said capacitor comprises a fourth of said plurality of intermediate operating states.

6. The abortable and safe method of explosively disintegrating an assembly of claim 5 wherein said step of initiating detonation of said explosive material upon transition through a selected plurality of said detonation controlling module and firing module operating states comprises a fifth operating state of said detonation controlling module.

7. The abortable and safe method of explosively disintegrating an assembly of claim 6 wherein said step of initiating detonation of said explosive material upon transition through a selected plurality of said detonation controlling module and firing module operating states includes energizing an electrical bridge wire detonation initiating element with electrical energy stored in said energy storage capacitor.

8. The abortable and safe method of explosively disintegrating an assembly of claim 7 wherein said communicating optical signals step coded optical energy comprises frequency coded pulses of optical energy.

9. The abortable and safe method of explosively disintegrating an assembly of claim 8 wherein said firing module coded optical energy-responsive electrical switching network includes electrical circuit means for decoding said frequency coded pulses of optical energy; and an electrical spark gap high voltage energy commutating element responsive to a spark initiating signal received from said electrical circuit means for decoding said frequency coded pulses of optical energy.

10. Instantly segregable elevated electrical potential apparatus comprising the combination of:

an assembly joined together in an electrically insulated, local explosive material-detonation responsive manner;

a source of elevated electrical potential connected between said assembly and a surrounding environment electrical node;

an electrically initiateable charge of explosive material located adjacent portions of said elevated electrical potential assembly;

a quantity-limited depletable source of explosive material-detonation initiating electrical energy located adjacent said charge of explosive material, said quantity-limited source of explosive material-detonation initiating electrical energy being also disposed at said elevated electrical potential with respect to said surrounding environment;

a wired conductor path inclusive of a coded optical energy responsive electrical switching element connecting said quantity-limited source of explosive material-detonation initiating electrical energy with said electrically initiateable charge of explosive material;

said quantity-limited depletable source of explosive material-detonation initiating electrical energy, said wired conductor path, and said coded optical energy responsive electrical switching element comprising an explosive material firing module also disposed at said elevated electrical potential with respect to said surrounding environment;

a detonation controlling module coupled with said firing module by a multiple parallel path fiber optic optical energy signal transmission apparatus;

said multiple parallel path fiber optic optical energy signal transmission apparatus being also electrically non conducting with respect to said elevated electrical potential of said assembly;

said detonation controlling module including electrical circuit means defining a successive sequence plurality of detonation controlling module and firing module operating states including an initial off state, a final state initiating detonating of said electrically initiateable charge of explosive material and a plurality of intermediate operating states;

said detonation controlling module and said firing module including optical signal transmission and reception means for communicating optical signals indicative of existence of selected of said detonation controlling module operating states between said detonation controlling module and said firing module coded optical energy-responsive electrical switching element via said multiple parallel path fiber optic optical energy signal transmission apparatus;

said detonation controlling module and said firing module including optical signal transmission and reception means for communicating optical signals indicative of existence of selected of said firing module operating states between said firing module and said detonation controlling module via said multiple parallel path fiber optic optical energy signal transmission apparatus;

said detonation controlling module also including manually electable operating state termination inputs enabling premature, and non detonating of said explosive material, resetting termination of a selected plurality of said intermediate states in said detonation controlling module and said firing module;

said quantity-limited depletable source of explosive material initiation electrical energy enabling time duration predictions of detonation energy available possible detonating of said explosive material and ensuing commencement of a remainder, insufficient detonation energy available, safe explosive material handling time; and manual operating means for initiating detonation of said explosive material upon transition through a selected plurality of said detonation controlling module and firing module operating states.

11. The instantly segregable elevated electrical potential apparatus of claim 10 further including:

a manually electable pneumatic control input member received on said detonation controlling module;

a pneumatic pressure conduit path paralleling said multiple parallel path fiber optic optical energy signal transmission apparatus and connecting said detonation controlling module with said firing module;

an electrical crowbar actuation element responsive to a pneumatic control input member pressure signal in said pneumatic pressure conduit path, located in said firing module and connected across an electrical input port of said electrically initiateable charge of explosive material in controllable protection of said explosive material.

12. The instantly segregable elevated electrical potential apparatus of claim 10 wherein said quantity-limited depletable source of explosive material-detonation initiating electrical energy includes an electrical battery of selected electrical capacity disposed in said firing module adjacent said charge of explosive material.

13. The instantly segregable elevated electrical potential apparatus of claim 12 wherein said source of explosive material-detonation initiating electrical energy includes:

a kilovolt-rated energy storage capacitor also located in said firing module; and DC to DC converter circuit means connected intermediate said electrical battery and said energy storage capacitor for charging said capacitor from a lower voltage received from said electrical battery.

14. The instantly segregable elevated electrical potential apparatus of claim 10 wherein said coded optical energy comprises frequency coded pulses of optical energy.

15. The instantly segregable elevated electrical potential apparatus of claim 14 wherein:

said firing module coded optical energy-responsive electrical switching element includes electrical circuit means for decoding said frequency coded pulses of optical energy; and an electrical spark gap high voltage energy commutating element responsive to a spark initiating signal received from said electrical circuit means for decoding said frequency coded pulses of optical energy.

16. The instantly segregable elevated electrical potential apparatus of claim 15 further including an electrical bridge wire detonation initiating element connected with said capacitor by way of said electrical spark gap high voltage energy commutating element.

17. The instantly segregable elevated electrical potential apparatus of claim 10 wherein said electrically initiateable charge of explosive material located adjacent structurally portions of said elevated electrical potential assembly comprises an electrically triggered explosive bolt member.

18. The abort-capable and safe method of rapidly segregating a mechanical assembly, operable at a pulsed elevated electrical potential with respect to a surrounding environment, into assembly component portions, said method comprising the steps of:

joining structural portions of said pulse elevated electrical potential mechanical assembly in a key element inclusive manner, said key element being local explosive material-detonation responsive;

locating an electrically initiateable charge of explosive material adjacent said key element of said elevated electrical potential mechanical assembly;

disposing an energy quantity-limited primary battery source of explosive material-detonation initiating electrical energy adjacent said charge of explosive material;

connecting said quantity-limited primary battery source of explosive material-detonation initiating electrical energy with said electrically initiateable charge of explosive material via a voltage increasing electrical inverter, an inverter-charged energy storage capacitor, an optical energy responsive spark-triggered spark gap electrical switching element and a coaxial conductor path of selected, and two meters maximum, length;

said electrically initiateable charge of explosive material, said primary battery, said electrical inverter, said inverter-charged energy storage capacitor, said optical energy responsive spark-triggered spark gap electrical switching element and said coaxial conductor path comprising an explosive material firing module, said explosive material firing module being also disposed at said pulsed elevated electrical potential with respect to said surrounding environment;

coupling said firing module optical energy responsive electrical switching element to a detonation controlling module via a six parallel paths fiber optic optical energy signal transmission array;

said six parallel paths fiber optic optical energy signal transmission array being also electrically non conducting with respect to said pulsed elevated electrical potential of said firing module and said mechanical assembly;

defining, within said detonation controlling module, a successive sequence plurality of manually indexed detonation controlling module and firing module operating states including an initial off state, a final detonation-initiating state initiating detonating of said electrically initiateable charge of explosive material and at least three intermediate operating states;

indicating existence of selected of said operating states in said detonation controlling module and said firing module using a visual display disposed on said detonation controlling module;

said successive sequence plurality of manually indexed detonation controlling module and firing module operating states including operating states having prematurely terminable duration, with safely aborted detonating of said explosive material, in response to manually initiated abort commands received at said detonation controlling module;

communicating optical signals relating to existence of selected of said detonation controlling module operating states between said detonation controlling module and said firing module optical energy-responsive electrical switching element via selected of said six parallel paths fiber optic optical energy signal transmission array;

communicating optical signals relating to existence of selected of said firing module operating states between said firing module and said detonation controlling module via selected of said six parallel path fiber optic optical energy signal transmission array;

said quantity-limited primary battery source of explosive material initiation electrical energy enabling predictions of a duration of detonation energy-available possible detonating of said explosive material and commencement of an ensuing terminal interval of insufficient detonation energy availability and safe explosive material manual-disarming;

enabling detonation of said explosive material by removing an electrical crowbar safety element from shunting of an explosive material electrical input port, said removing step including applying pneumatic pressure through an electrically insulating tubing member, disposed along said six parallel paths fiber optic optical energy signal transmission array, to a pressure responsive crowbar control element located in said firing module, said enabling and said removing being in response to a manual enabling command received at said detonation controlling module; and initiating detonation of said explosive material by firing an explosive material-adjacent bridge wire element, a bridge wire element electrically comprising said explosive material electrical input port, upon execution of said manual enabling command and transition through an unaborted, completed, selected plurality of said detonation controlling module and firing module operating states.

19. The abort-capable and safe method of rapidly segregating a mechanical assembly of claim 18 wherein:

said mechanical assembly includes both metallic and non-metallic component portions;

said segregated mechanical assembly includes segregated portions smaller than said component portions.

20. The abort-capable and safe method of rapidly segregating a mechanical assembly of claim 18 wherein said pulsed elevated electrical potential comprises a potential between zero volts and megavolts of electrical potential.

* * * * *